US009951957B2

(12) United States Patent
Park et al.

(10) Patent No.: US 9,951,957 B2
(45) Date of Patent: Apr. 24, 2018

(54) AIR-COOLED COMBUSTION FURNACE SYSTEM

(71) Applicant: YS CO., LTD., Ulsan (KR)

(72) Inventors: Jun Hyun Park, Busan (KR); Jae Jeong Lee, Busan (KR); Min Choul Kim, Busan (KR); Dong Je Seong, Ulsan (KR)

(73) Assignee: YS CO., LTD., Ulsan (KR)

( * ) Notice: Subject to any disclaimer, the term of this patent is extended or adjusted under 35 U.S.C. 154(b) by 396 days.

(21) Appl. No.: 14/428,216

(22) PCT Filed: Aug. 28, 2013

(86) PCT No.: PCT/KR2013/007737
§ 371 (c)(1),
(2) Date: Mar. 13, 2015

(87) PCT Pub. No.: WO2014/042369
PCT Pub. Date: Mar. 20, 2014

(65) Prior Publication Data

US 2015/0247642 A1 Sep. 3, 2015

(30) Foreign Application Priority Data

Sep. 13, 2012 (KR) ..... 10-2012-0101658

(51) Int. Cl.
*F24C 1/14* (2006.01)
*F24B 1/02* (2006.01)
(Continued)

(52) U.S. Cl.
CPC ..... *F24B 1/024* (2013.01); *F23B 40/04* (2013.01); *F23B 60/00* (2013.01); *F23H 15/00* (2013.01);
(Continued)

(58) Field of Classification Search
CPC ..... C10J 3/34; C10J 3/42; F23G 2203/805; F23J 1/06; F23J 1/00; F23H 1/02;
(Continued)

(56) References Cited

U.S. PATENT DOCUMENTS 3,605,370 A * 9/1971 Prible ..... F27D 1/06 373/137
3,921,545 A * 11/1975 Ruegsegger ..... F23G 5/444 100/95
(Continued)

FOREIGN PATENT DOCUMENTS

JP 08-058527 3/1994
KR 10061418 8/2006
(Continued)

OTHER PUBLICATIONS

English translation of the Gim reference.*

*Primary Examiner* — Jason Lau
(74) *Attorney, Agent, or Firm* — IPLA P.A.; James E. Bame

(57) ABSTRACT

Provided is an air cooled combustion furnace system to effectively operate a combustion furnace for generation of heat energy via combustion of a solid fuel so as to optimize thermal efficiency. The combustion furnace system includes a combustion body structure provided with a hopper and having a combustion space for production of heat energy via combustion of a solid fuel, a cooling device integrally formed in multiple layers with the combustion body structure to cool the combustion body structure via distribution of air, a negative pressure induction device to create a negative pressure within the combustion body structure by suctioning air, a fuel supply device, a grate device constructed by coupling a plurality of grate segments to one another and serving to support the solid fuel being combusted, and a
(Continued)

clinker removal device to remove clinkers generated during combustion of the solid fuel from the grate device.

12 Claims, 20 Drawing Sheets

(51) Int. Cl.

| | |
|---|---|
| ***F23M 5/08*** | (2006.01) |
| ***F23B 40/04*** | (2006.01) |
| ***F23B 60/00*** | (2006.01) |
| ***F23H 15/00*** | (2006.01) |
| ***F24B 5/00*** | (2006.01) |
| ***F24B 7/04*** | (2006.01) |
| ***F24B 13/00*** | (2006.01) |
| ***F24B 13/02*** | (2006.01) |
| ***F24B 13/04*** | (2006.01) |

(52) U.S. Cl.
CPC ..... *F23M 5/08* (2013.01); *F24B 5/00* (2013.01); *F24B 7/04* (2013.01); *F24B 13/006* (2013.01); *F24B 13/02* (2013.01); *F24B 13/04* (2013.01)

(58) Field of Classification Search
CPC ... F23H 15/00; F23H 7/08; F23H 9/02; F23H 17/06; F23H 1/00; F23H 7/04; F23M 5/08; F23M 5/085; F23M 5/00; F23B 60/02; F23B 60/00; F02D 41/0007; F02D 17/02; F02D 2200/0802; F02D 23/00; F02D 41/0087; F02D 41/1446; F02D 9/02; F02D 2200/0406; F02D 29/06; F02D 35/027; F02D 41/0002; F02D 41/0055; F02D 41/0235; F02D 41/024; F02C 6/08; F02C 9/18; F02C 7/18; F02C 7/12; F02C 7/185; F02C 7/32; F02C 9/28
See application file for complete search history.

(56) References Cited

U.S. PATENT DOCUMENTS

| | | | | |
|---|---|---|---|---|
| 5,201,652 | A * | 4/1993 | Kawamura | F28C 3/16 432/14 |
| 6,485,296 | B1 * | 11/2002 | Bender | C10J 3/14 110/203 |
| 6,875,409 | B1 * | 4/2005 | Zhou | B01D 53/944 423/239.1 |
| 2003/0046938 | A1 * | 3/2003 | Mortzheim | F01D 17/105 60/782 |

FOREIGN PATENT DOCUMENTS

| | | |
|---|---|---|
| KR | 1020110041170 | 4/2011 |
| KR | 1020110137915 | 12/2011 |

* cited by examiner

[Fig. 1]
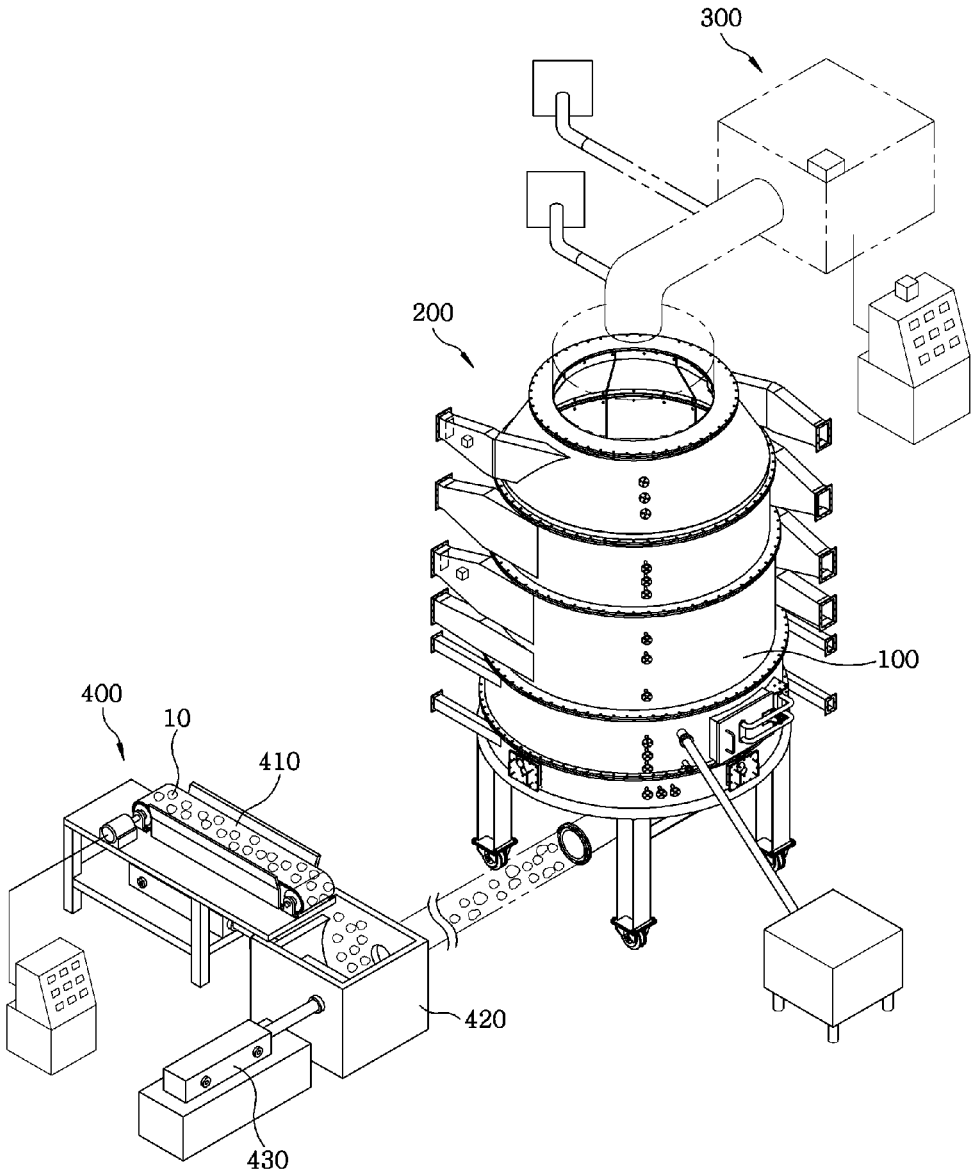

[Fig. 2]
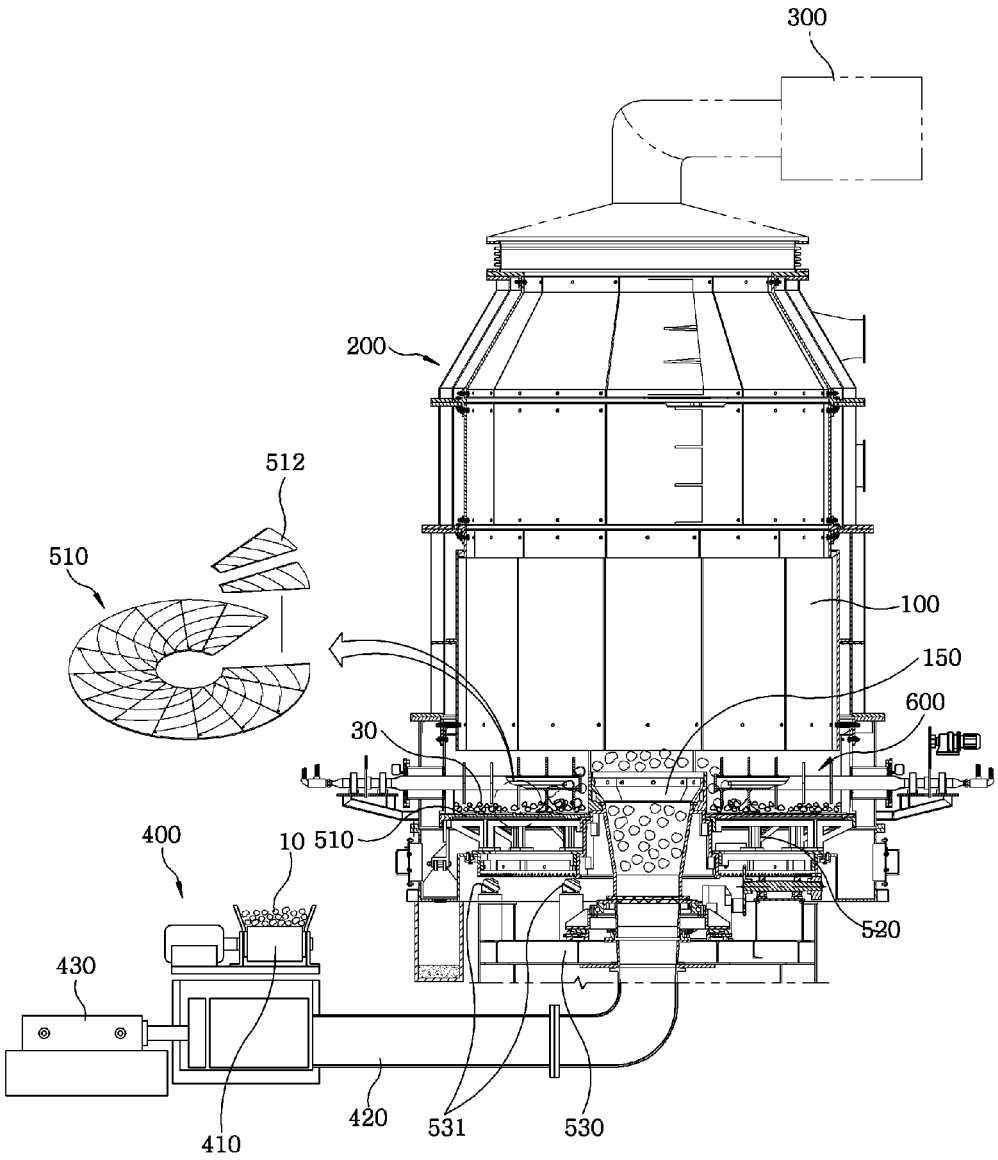

[Fig. 3]
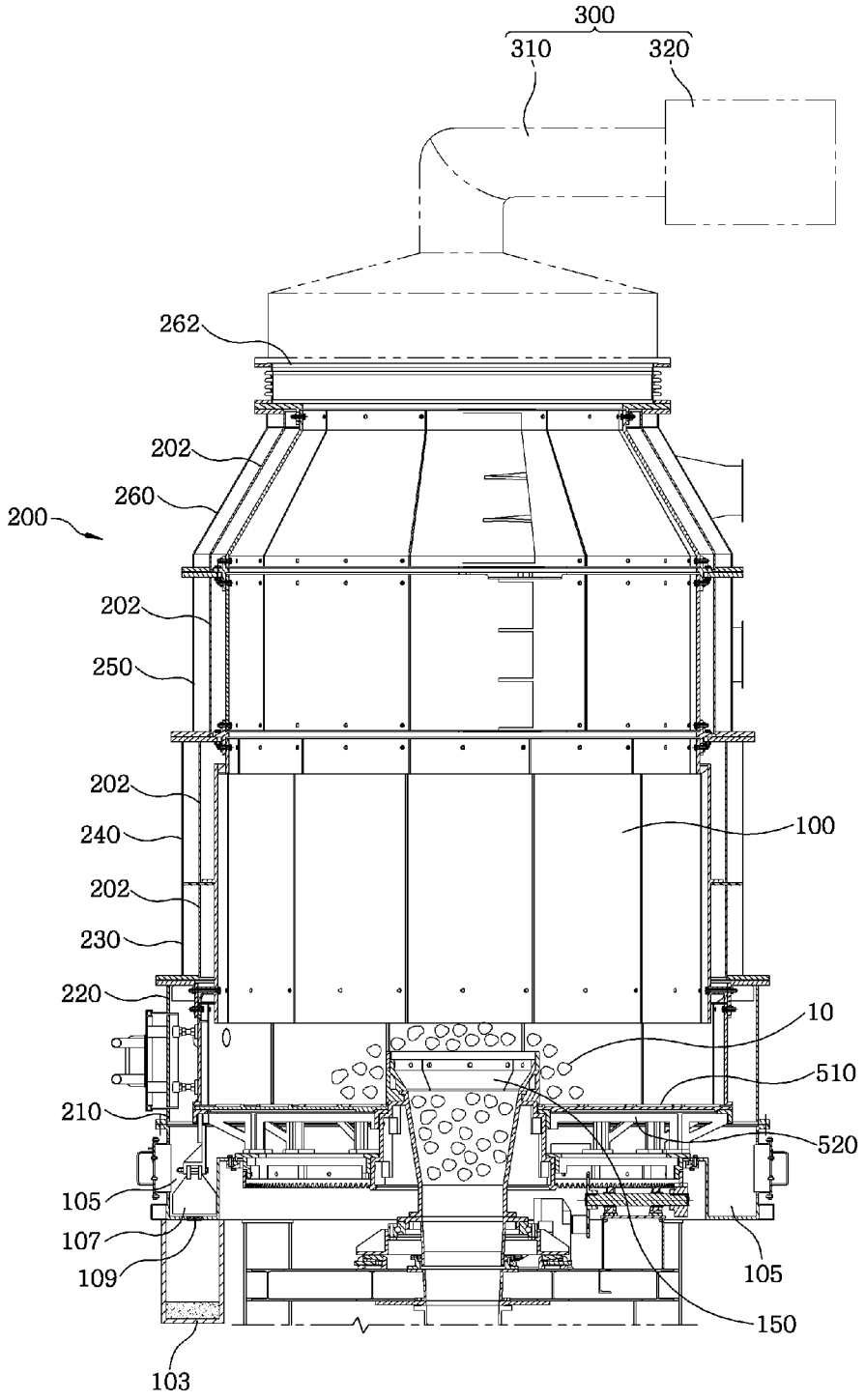

[Fig. 4]
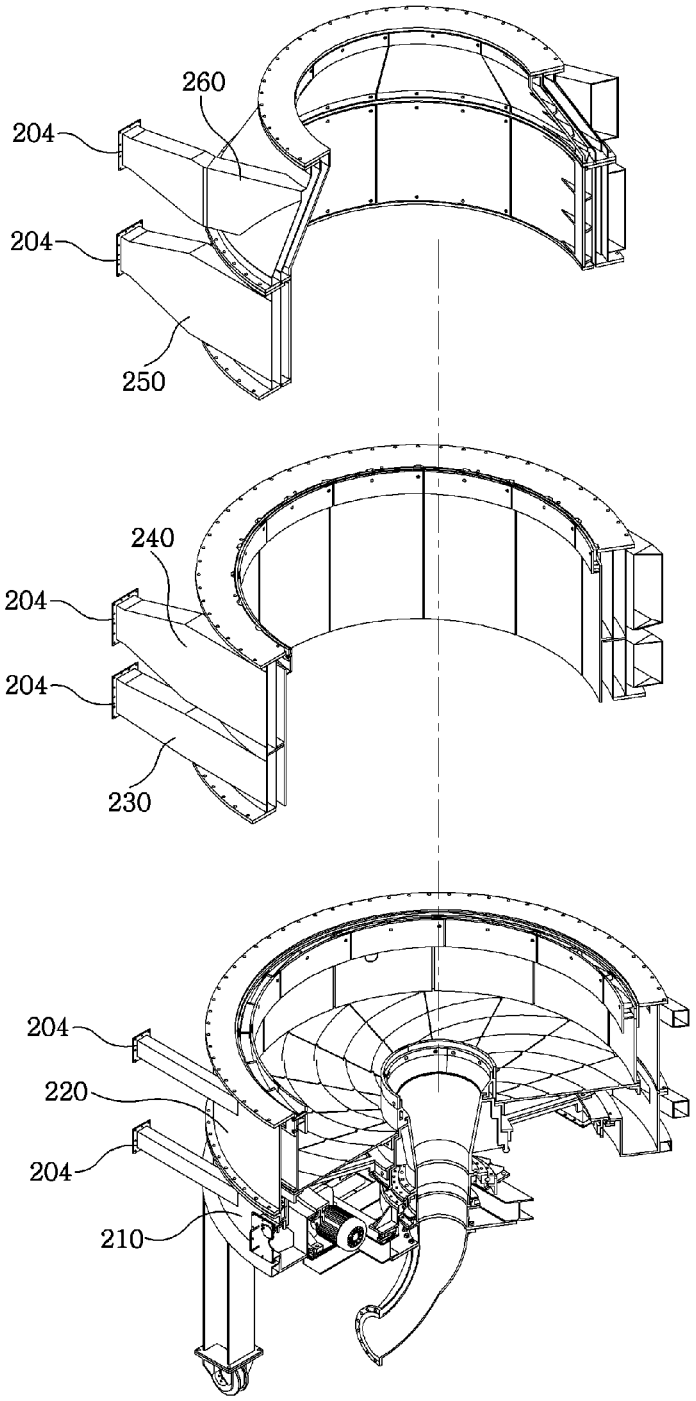

[Fig. 5]
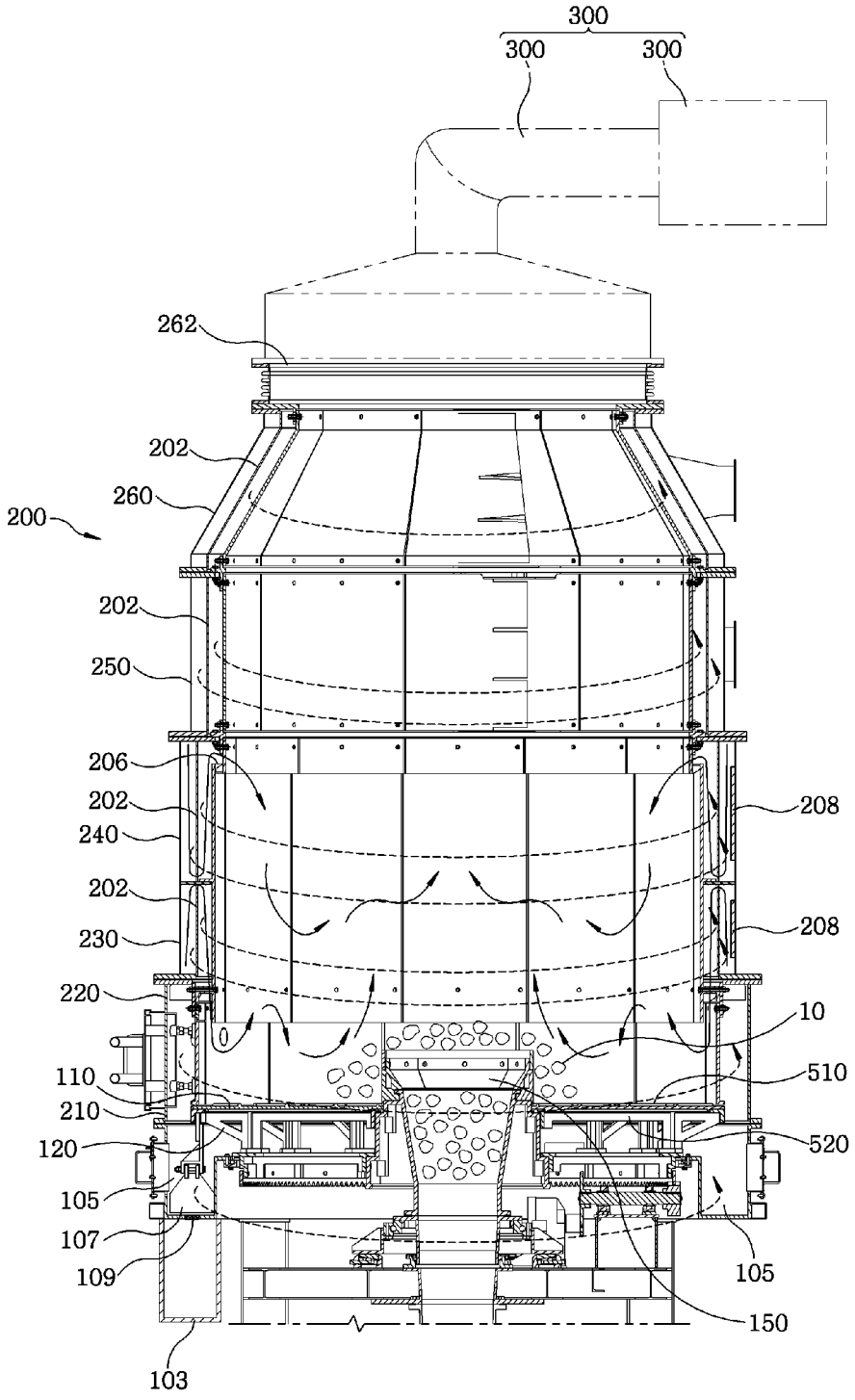

[Fig. 6]
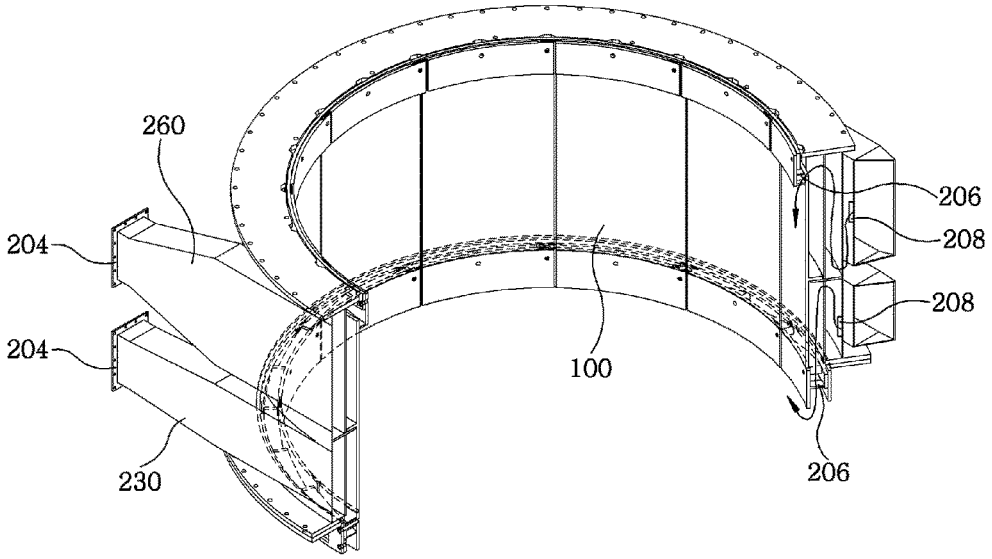
[Fig. 7]
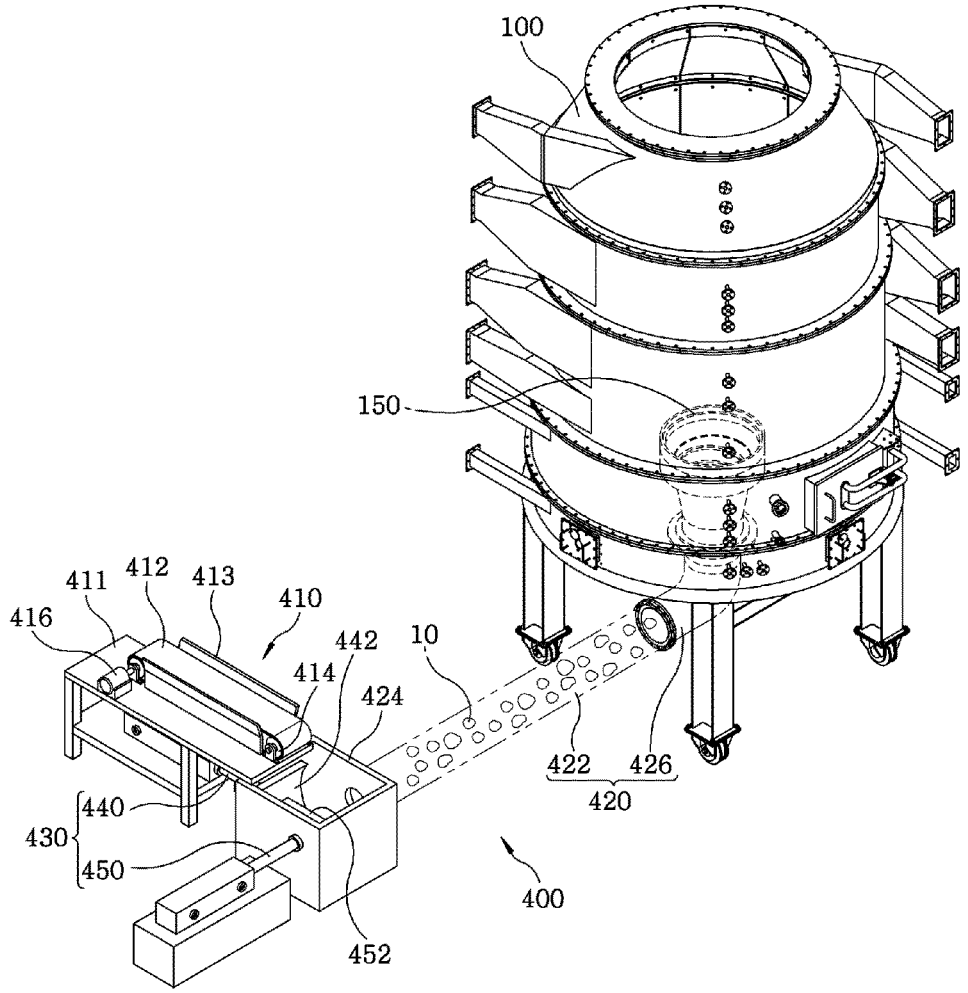

[Fig. 8]
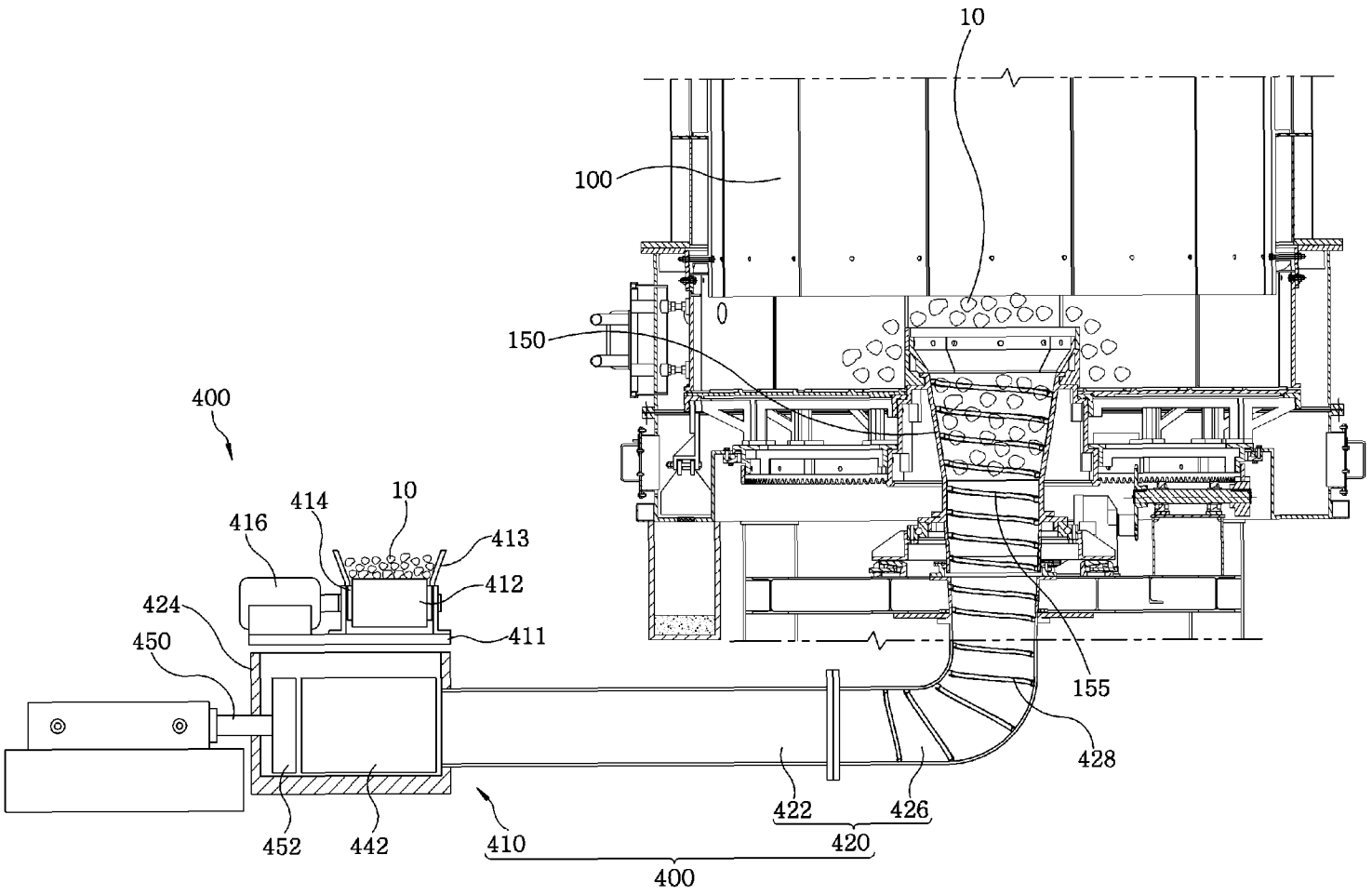

[Fig. 9]
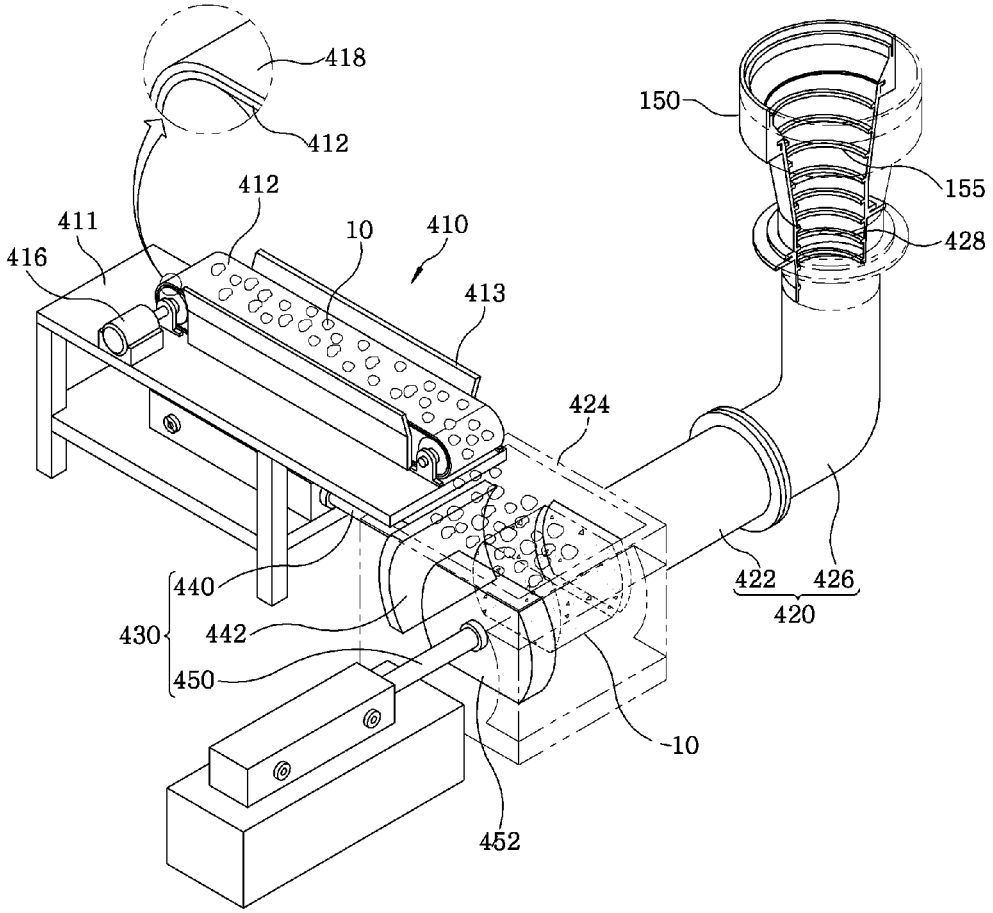

[Fig. 10]
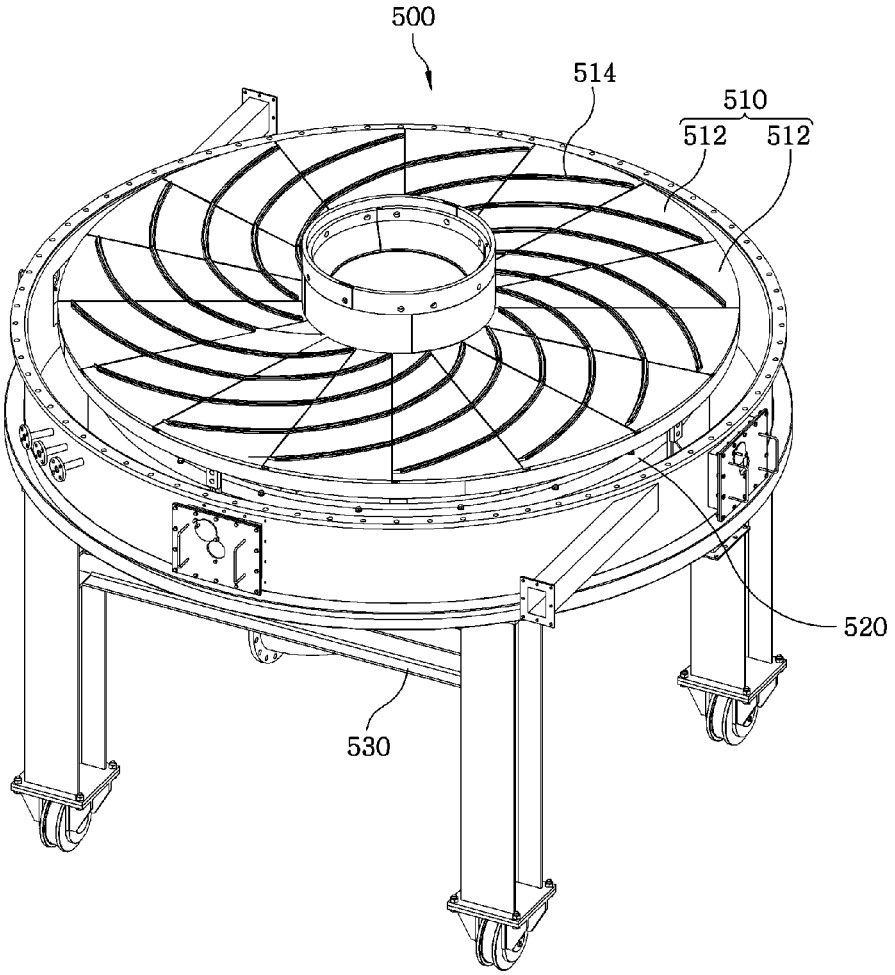

[Fig. 11]
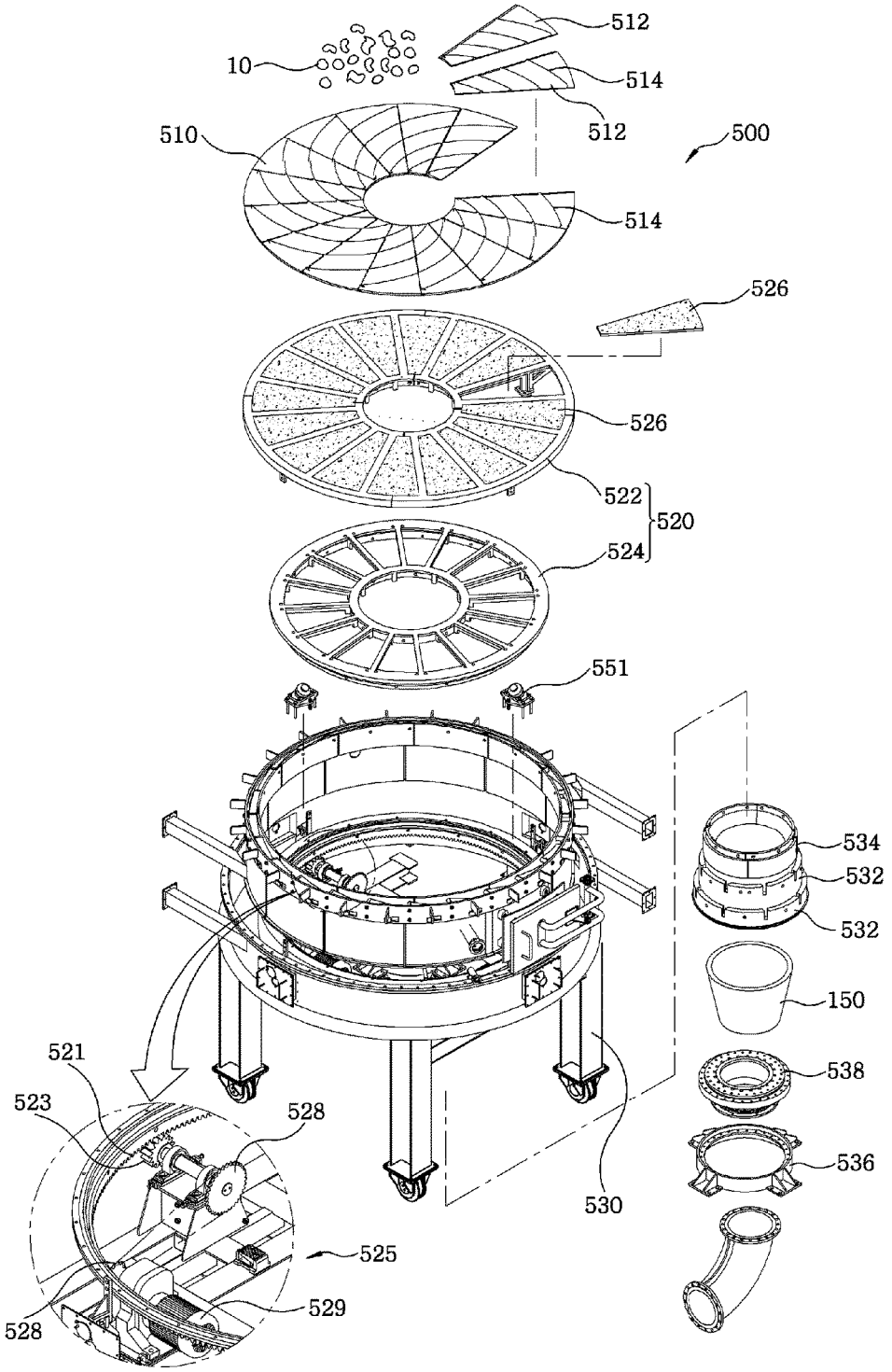

[Fig. 12]
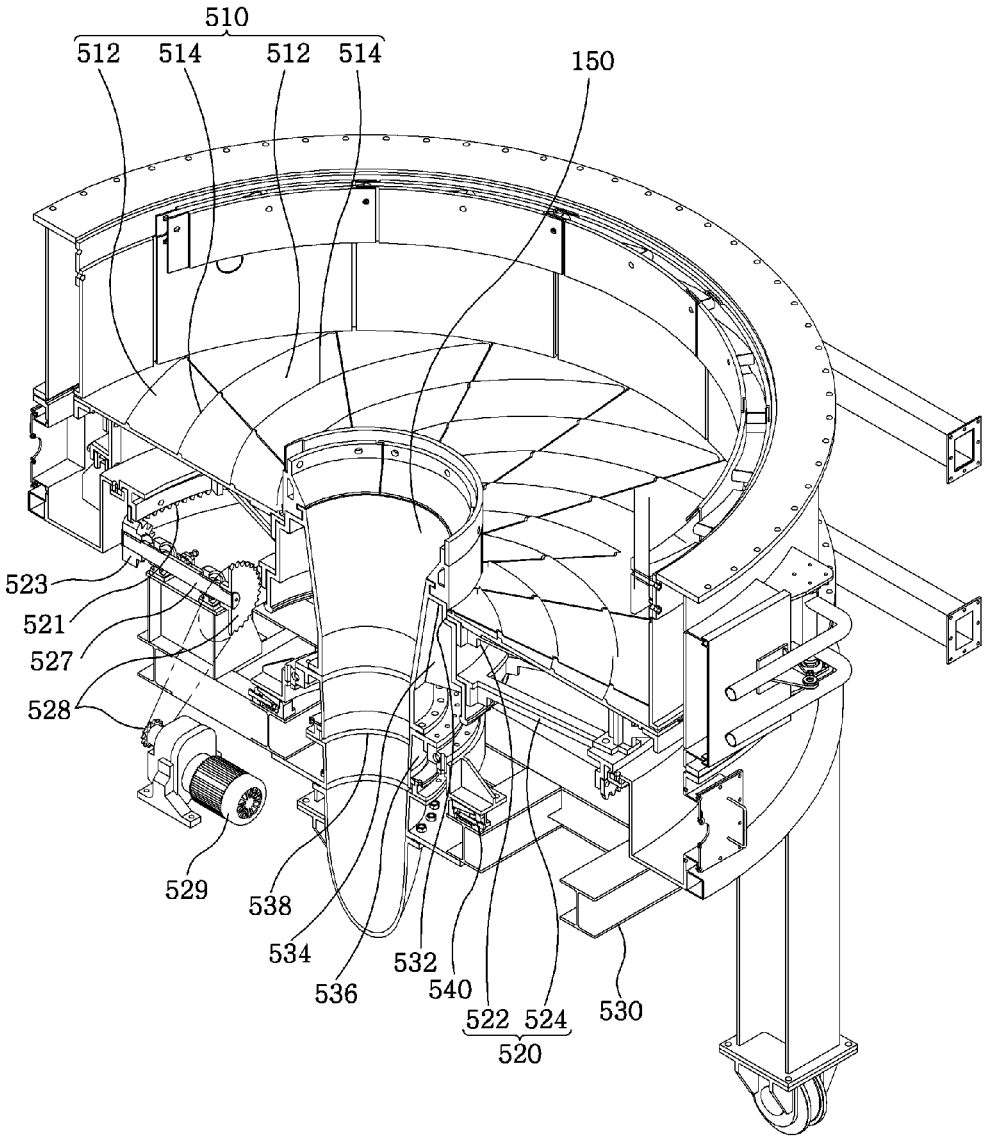

[Fig. 13]
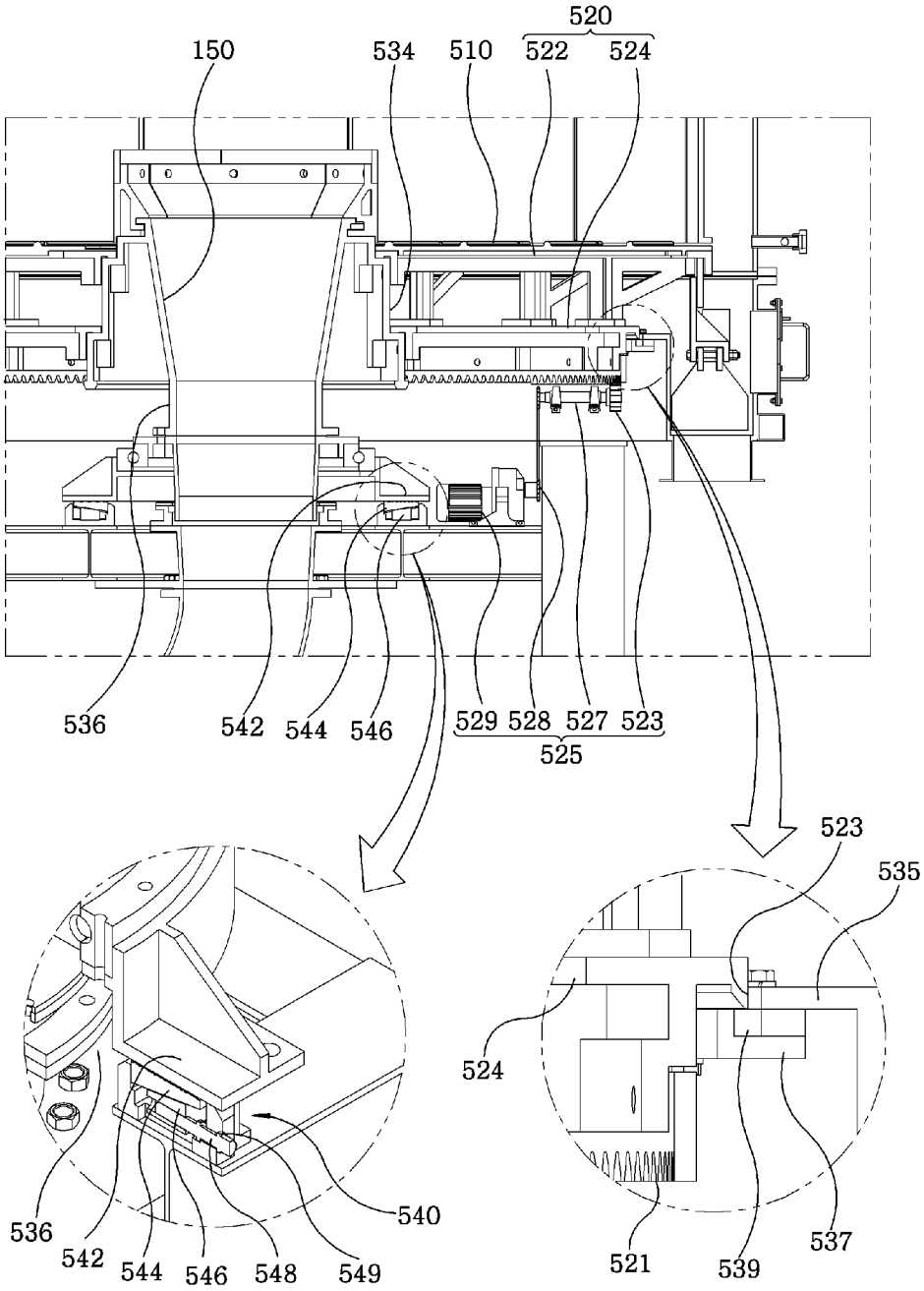

[Fig. 14]
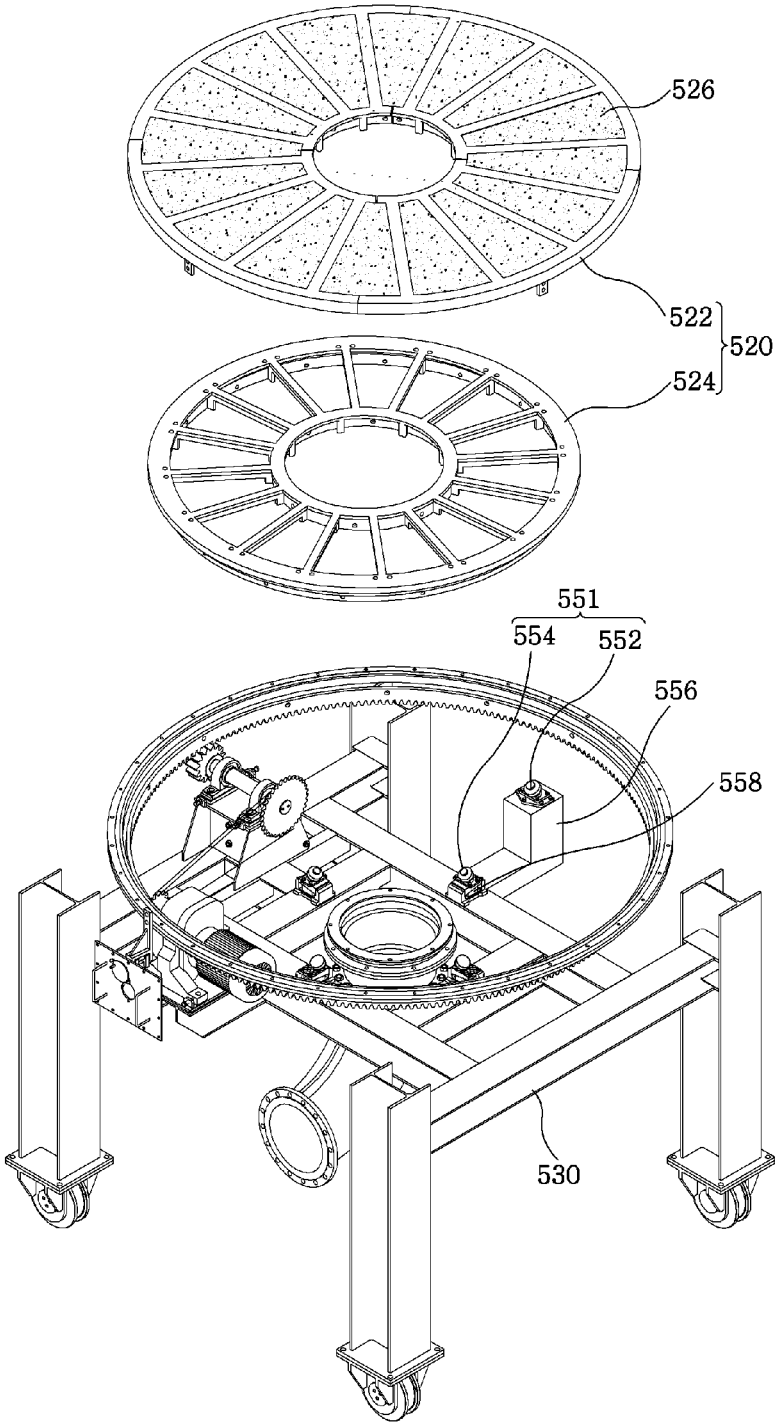

[Fig. 15]
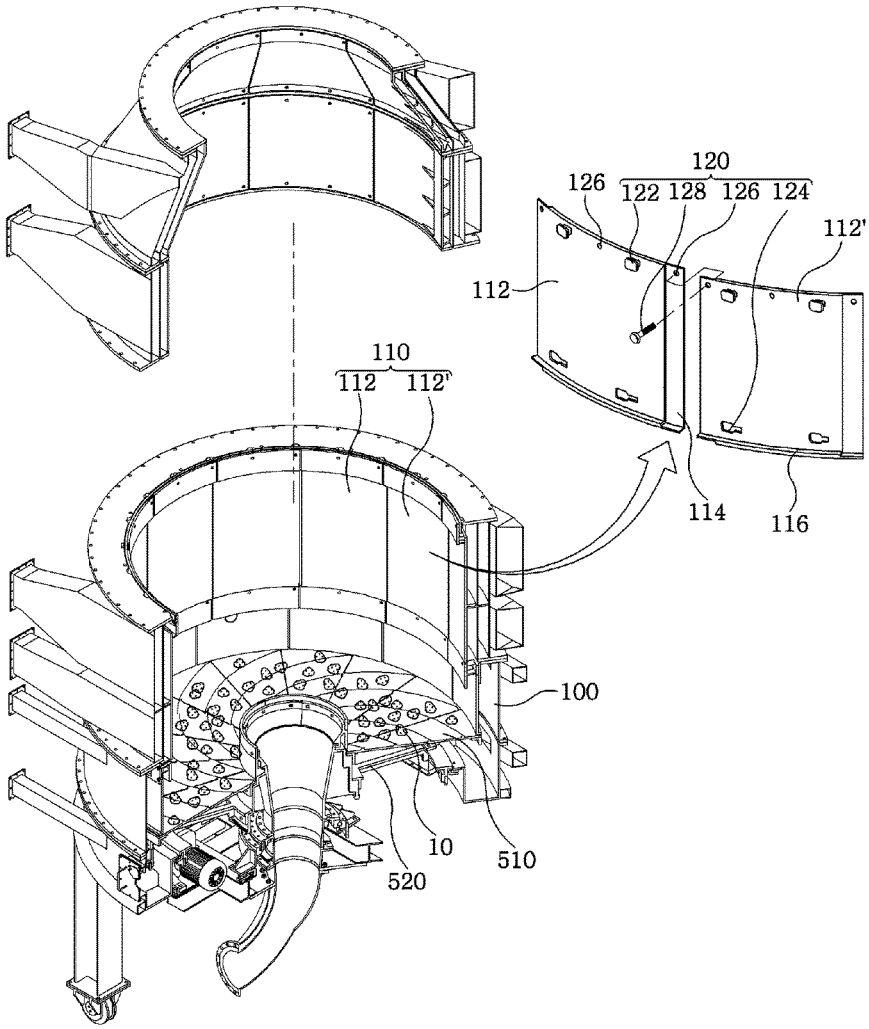
[Fig. 16a]
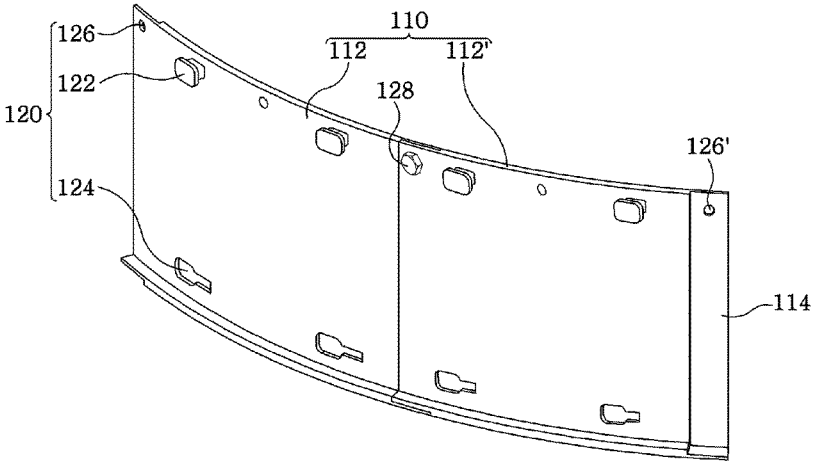

[Fig. 16b]
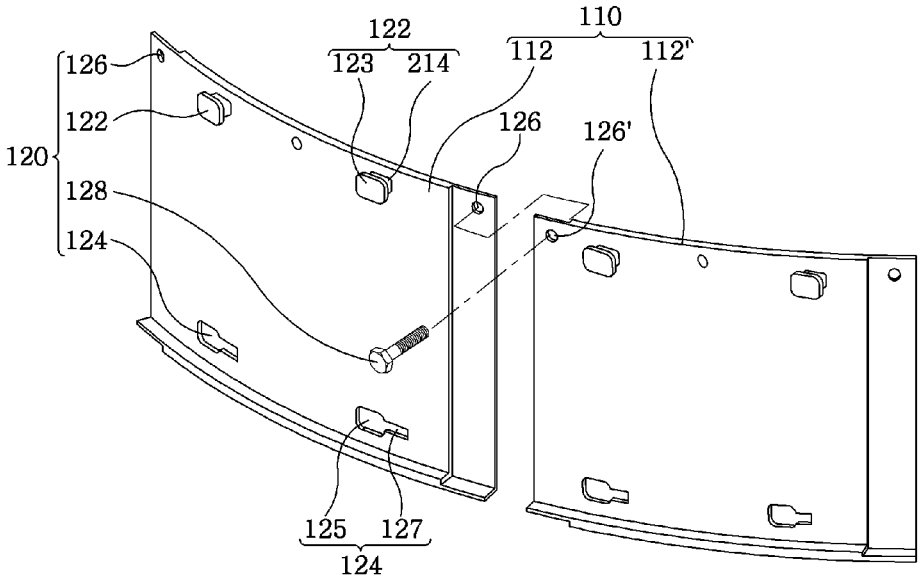
[Fig. 17a]
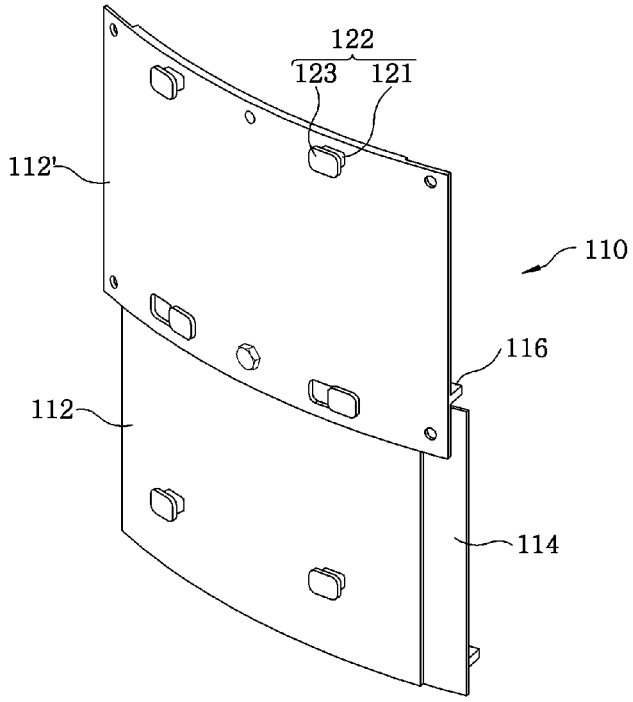

[Fig. 17b]
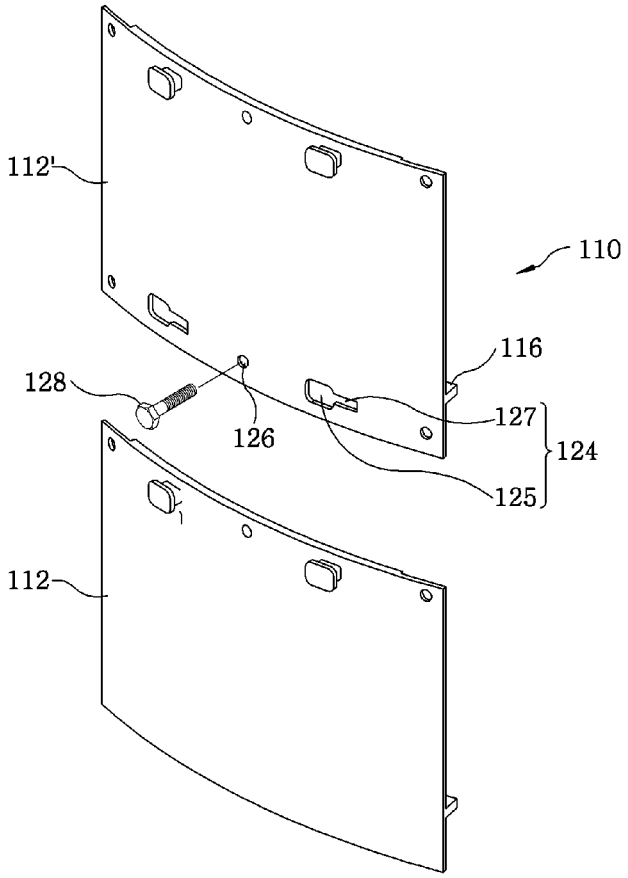
[Fig. 18]
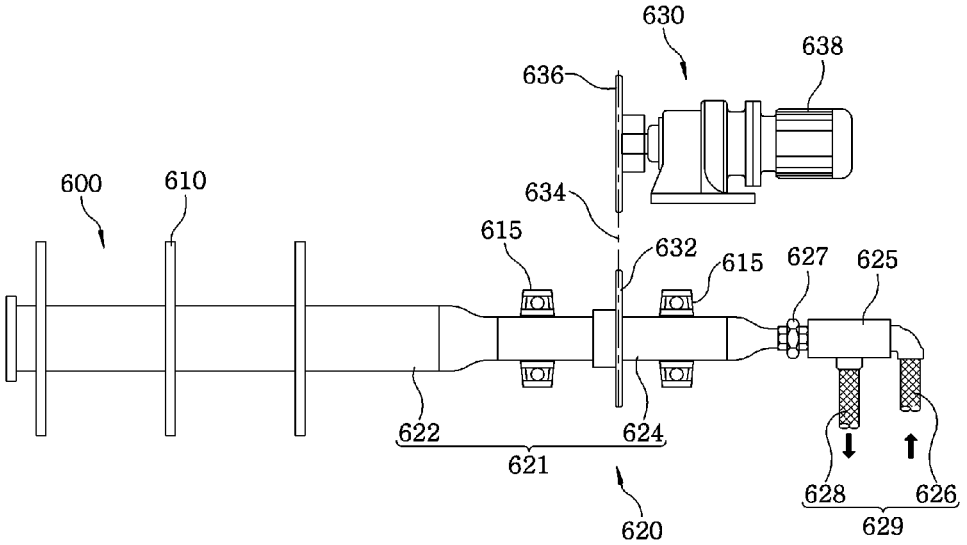

[Fig. 19]
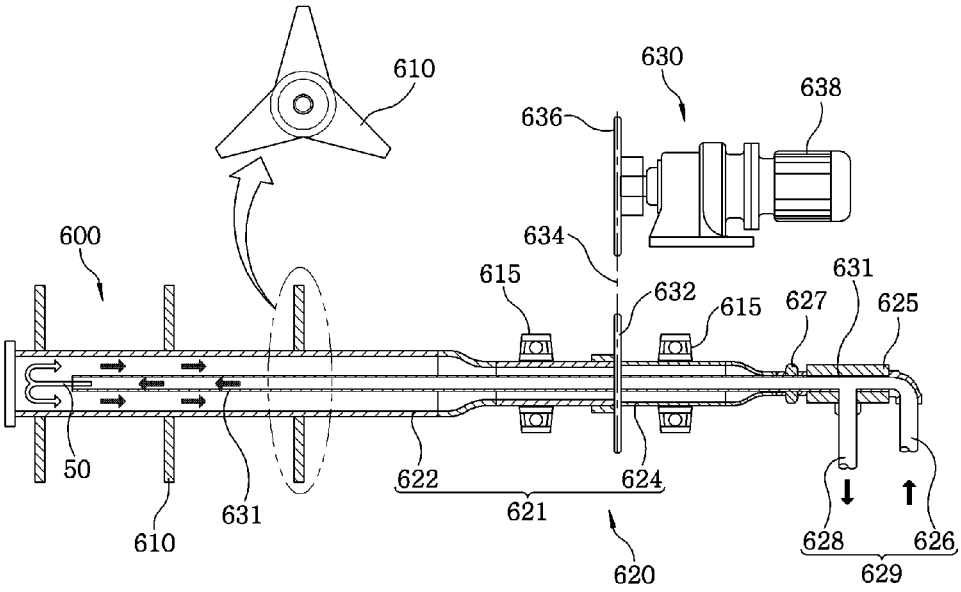

[Fig. 20]
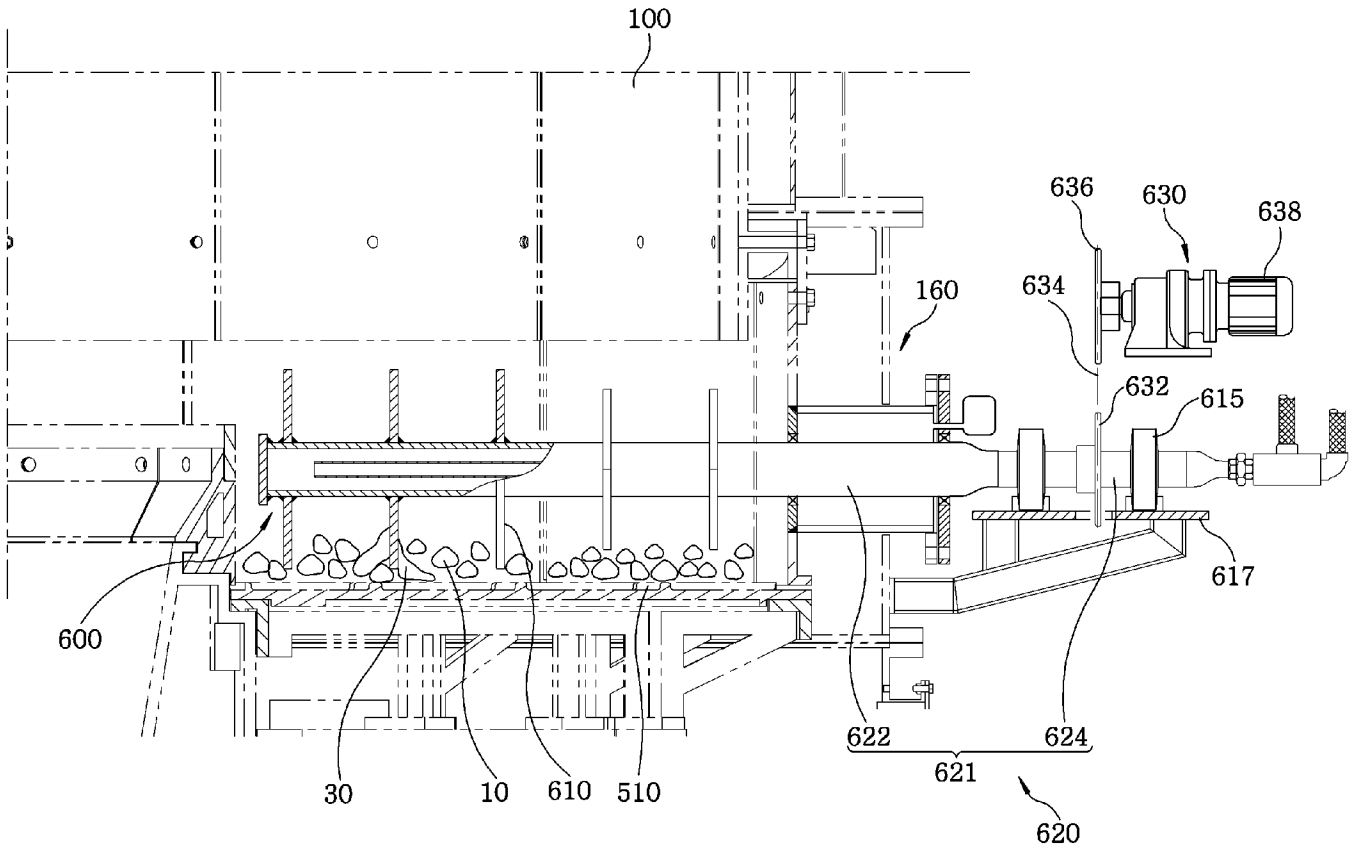

[Fig. 21]
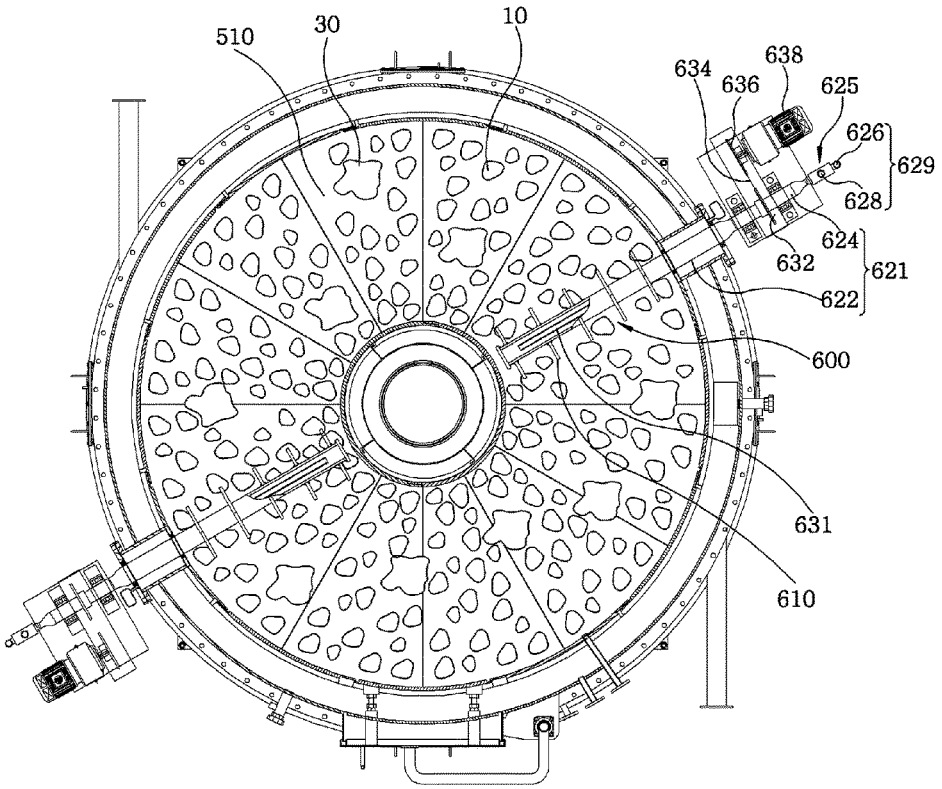
[Fig. 22]
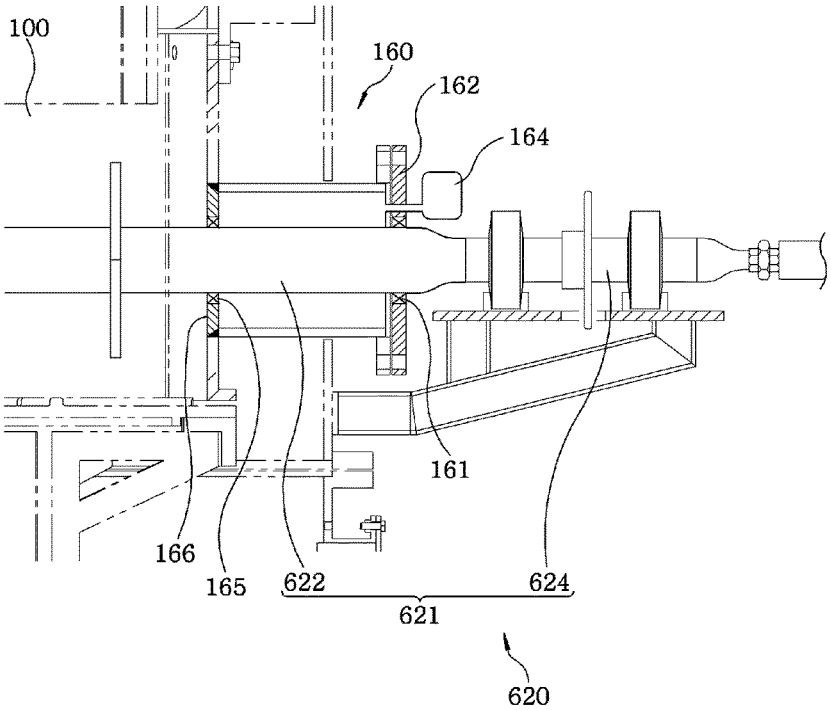

[Fig. 23]
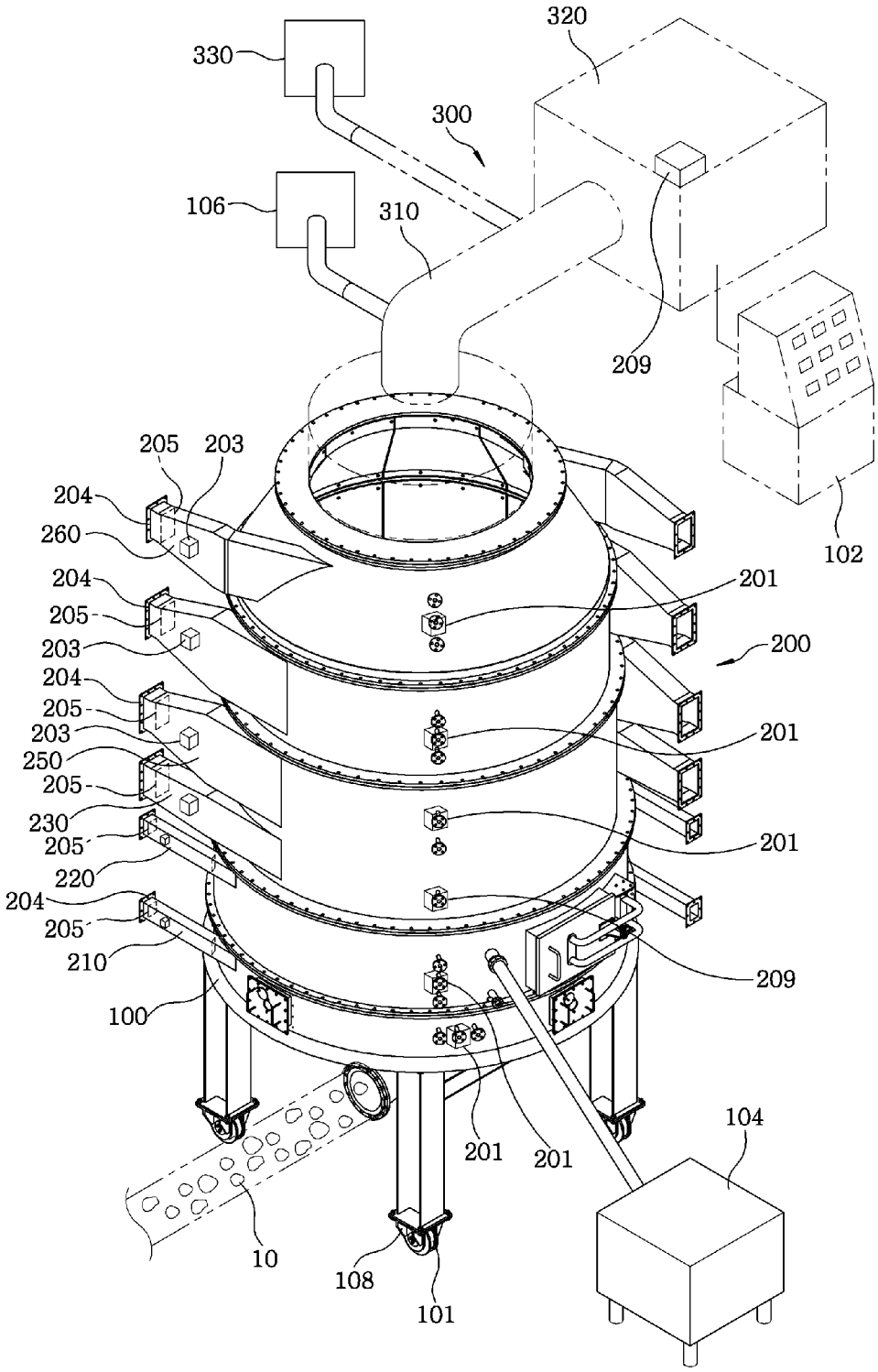

AIR-COOLED COMBUSTION FURNACE SYSTEM

BACKGROUND

The present invention relates to an air cooled combustion furnace system which effectively operates a combustion furnace so as to optimize thermal efficiency.

Generally, an incinerator produces a flame and generates fuel combustion inside a combustion chamber. The combustion chamber burns an introduced refuse or fuel using a flame or implements pyrolysis (carbonization) of the refuse or fuel and, in some cases, reburns an unburned gas-phase material.

In such an incinerator, there is used a solid fuel in the form of pellets that are produced by compressing sawdust or wood fragments as well as waste plastic generated at work or at home. An apparatus for burning a solid fuel to acquire heat for use in, for example, a boiler or a cogeneration plant has been developed.

Boilers using a solid fuel have been widely used because they do not use, for example, diesel or bunker-C oil that is a greenhouse gas source and, therefore, may advantageously reduce fuel costs and be eco-friendly. The use range of these boilers is expanding to exclusive boilers for facilities with high fuel consumption as well as boilers for power plants or cogeneration plants of local governments.

However, conventional boilers have a limit to increase combustion efficiency because they simply burn a solid fuel by supplying outside air thereto. Therefore, there is a need to improve an air supply method so as to enable more efficient combustion, rather than simply supplying air.

In addition, during burning of a solid fuel, a great amount of ashes and impurities such as glass powder or soil included in the solid fuel are fused and agglomerated at high temperatures within a combustion furnace, generating slags and clinkers. When the generated ashes are deposited on respective constituent elements of a combustion apparatus without being rapidly discharged to the outside, this may cause deterioration in combustion efficiency and breakdown of the combustion apparatus. Accordingly, when, for example, ash or slag deposits are not removed, malfunction of the combustion apparatus may occur and a system may undergo operation stop and, moreover, explosion, which may cause injury of a worker or a serious accident such as, for example, a fire.

In addition, even if the incinerator including the combustion chamber is very firmly fabricated, there is a risk of thermal damage to constituent elements inside and outside the combustion chamber because the high temperature of 1000° C. or more is generated within the combustion chamber.

In addition, in a process of cooling the wall surface of the combustion chamber using air, although the combustion chamber may be locally cooled when the air is concentrated in a local region of the wall surface of the combustion chamber, it is almost impossible to cool the other region, which may cause a critical problem in continuous operation of the system and reduce the lifespan of the system.

In addition, when a given amount of solid fuel is not introduced into the combustion chamber at a given time, excessive supply of the solid fuel may generate excessive heat, which may cause a fire.

In addition, when the inner wall of the combustion chamber or nearby devices are damaged by high temperatures caused by burning of the solid fuel, there is a problem in that the inner wall of the combustion chamber or the entire combustion chamber needs to be replaced. In particular, when a grate is partially damaged, the entire grate and a turntable to rotate the grate need to be replaced, causing economic loss.

SUMMARY OF THE INVENTION

Therefore, the present invention has been made in view of the above problems, and it is an object of the present invention to provide an air cooled combustion furnace system which is capable of uniformly distributing air, used to cool a combustion furnace, throughout the wall surface of the combustion furnace, thereby accomplishing efficient cooling of the combustion furnace.

Another object of the present invention is to provide an air cooled combustion furnace system which is capable of raising combustion air within a combustion furnace by introducing a swirl of preheated air into the combustion furnace at a high speed while cooling the outer wall of the combustion furnace and causing the air to be appropriately mixed with a fuel, thereby accomplishing enhanced combustion efficiency.

Another object of the present invention is to provide an air cooled combustion furnace system which is capable of quantitatively controlling supply of a solid fuel into a combustion furnace such that a given amount of the solid fuel is introduced at a given time, thereby preventing any accident such as, for example, a fire and explosion due to excessive fuel supply.

Another object of the present invention is to provide an air cooled combustion furnace system which is capable of allowing simplified replacement of a damaged portion of a combustion furnace when the inner wall of the combustion furnace is partially damaged.

A further object of the present invention is to provide an air cooled combustion furnace system which is capable of allowing simplified replacement of a deformed portion of a grate when the grate, configured to support a solid fuel being burned in a combustion furnace, is thermally deformed.

In accordance with an aspect of the present invention, to accomplish the above and other objects, an air cooled combustion furnace system includes a combustion body structure including a hopper for introduction of a solid fuel into the combustion body structure, the combustion body structure defining a combustion space in which the solid fuel introduced through the hopper is combusted and generates heat energy, a cooling device integrally formed at an outer surface of the combustion body structure, the cooling device being vertically divided into a plurality of stories to cool the combustion body structure via distribution and injection of air into the respective stories, a negative pressure induction device connected to the top of the combustion body structure, the negative pressure induction device being configured to create a negative pressure within the combustion body structure by suctioning air introduced into the combustion body structure by the cooling device, a fuel supply device extending into the combustion body structure from the outside so as to supply the solid fuel into the combustion body structure, a grate device including a grate located within the combustion body structure to define a bottom surface of the combustion body structure, the grate being constructed by coupling a plurality of grate segments to one another and configured to support the solid fuel during combustion of the solid fuel, the grate device allowing the solid fuel to be combusted while being disposed on an upper surface thereof, and a clinker removal device configured to remove clinkers generated as the solid fuel is combusted on the grate device The combustion body structure may include a plurality of assembly units configured to be assembled with one another so as to construct an inner wall of the combustion body structure and a connection unit configured to enable separable coupling of the assembly units.

The fuel supply device may include a conveyor configured to convey the solid fuel, a tubular cylinder into which the solid fuel conveyed from the conveyor is introduced and a cylinder rod configured to be partially inserted into the cylinder so as to push and convey the solid fuel introduced into the cylinder via reciprocating movement thereof.

The grate device may further include a turntable connected to the bottom of the grate to rotate the grate, the grate being configured to surround an outer surface of the hopper and a support body configured to support the bottom of the turntable, the support body being provided at an upper surface thereof with a roller to assist rotation of the turntable and supported at a lower surface thereof by the ground.

The support body may include an auxiliary body fixed to the hopper so as to surround the outer surface of the hopper, the auxiliary body being provided at an outer surface thereof with multiple stepped portions to support inner rims of the turntable and the grate, a cylindrical up-and-down moving pipe connected to a lower portion of the hopper and a height regulator fixed to an outer circumference of the up-and-down moving pipe so as to upwardly or downwardly move the up-and-down moving pipe.

The height regulator may include an elevating plate horizontally connected to the up-and-down moving pipe, an inclined plate located below the elevating plate and having an outwardly downwardly inclined side cross section, a moving piece located below the inclined plate and having an outwardly upwardly inclined side cross section, the moving piece being moved inside the inclined plate so as to upwardly or downwardly move the inclined plate, a screw bolt configured to be rotated inside the moving piece so as to move a position of the moving piece, and a stopper protruding from an outer surface of the screw bolt to control movement of the moving piece on the screw bolt.

The cooling device may include a flow rate sensor configured to measure a pressure of air supplied into the cooling device and an air regulation device configured to regulate the flow rate of air supplied into the cooling device according to the pressure of air measured by the flow rate sensor, the negative pressure induction device may include a pressure sensor configured to measure an interior pressure of the combustion body structure and a temperature sensor configured to measure an interior temperature of the combustion body structure, and the combustion body structure may include a controller configured to receive a flow rate value and a pressure value measured by the flow rate sensor and the pressure sensor and to control the air regulation device and the negative pressure induction device based on the flow rate value and the pressure value.

The combustion body structure may further include a start-up burner configured to produce a flame within the combustion body structure so as to ignite the solid fuel and an energy converter configured to convert heat energy generated in the combustion body structure into steam or electricity, and the negative pressure induction device may include a flue connected to the top of the combustion body structure, a negative pressure generator connected to the flue and a noxious gas processing unit located between the flue and the negative pressure generator to remove or decompose a combustion gas containing a gas-phase noxious material and noxious material particles.

The cooling device may include a first cooler configured to supply air to the bottom of the combustion body structure so as to cool the bottom of the combustion body structure, a second cooler assembled to the top of the first cooler, the second cooler being configured to supply air so as to cool a lower outer surface of the combustion body structure, a third cooler assembled to the top of the second cooler, the third cooler having a vertical partition to divide the interior of the third cooler into two regions and configured to allow air, introduced from the outside, to be directed to an inner lower region of the combustion body structure, a fourth cooler assembled to the top of the third cooler, the fourth cooler having a vertical partition to divide the interior of the fourth cooler into two regions and configured to allow air, introduced from the outside, to be directed to a region between an inner upper region and the inner lower region of the combustion body structure, a fifth cooler assembled to the top of the fourth cooler, the fifth cooler having a vertical partition to divide the interior of the fifth cooler into two regions and configured to allow air, introduced from the outside, to be circulated along the inner side and the outer side of the partition so as to cool the outer surface of the combustion body structure and a sixth cooler assembled to the top of the fifth cooler, the sixth cooler having a diagonal partition to divide the interior of the sixth cooler into two regions and also having a top opening, the sixth cooler being shaped such that an inner diameter thereof is gradually reduced upward and configured to allow, air introduced from the outside, to be circulated along the inner side and the outer side of the partition so as to cool the outer surface of the combustion body structure.

Each of the first, second, third, fourth, fifth and sixth coolers may have an air inlet port configured to receive air from the outside and to supply the air to the combustion body structure.

Each of the third cooler and the fourth cooler may accommodate an eddy piece configured to guide diagonal movement of air introduced from the outside so as to allow the air to be swirled in the cooler.

The clinker removal device may include a clinker remover inserted into the combustion body structure to remove clinkers generated at the grate, a clinker cooler configured to extend from the interior of the clinker remover to the outside of the combustion body structure through an entrance guide device formed at a lower portion of the combustion body structure, so as to cool the clinker remover via circulation of water or air and a power transmission mechanism connected to the clinker cooler at the outside of the combustion body structure, the power transmission mechanism being configured to transmit power to enable rotation of the clinker cooler.

The clinker cooler may include a cooling housing composed of a rod-shaped inner cooling pipe inserted into the combustion body structure through the entrance guide device and a rod-shaped outer cooling pipe extending from the inner cooling pipe so as to be located at the outside of the combustion body structure, a partitioned cooling vessel configured to extend outward from the outer cooling pipe so as to separate cooling water, introduced from the outside, from cooling water to be discharged outward after being circulated through the cooling housing, a joint configured to interconnect the cooling housing and the partitioned cooling vessel so as to maintain the partitioned cooling vessel in a stationary state during rotation of the cooling housing, a supply and drain pipe consisting of an inlet pipe connected to an outer surface of the partitioned cooling vessel for introduction of the cooling water and an outlet pipe for discharge of the cooling water circulated in the cooling housing and a cooling supply pipe connected to the inlet pipe to extend through the interior of the partitioned cooling vessel and the interior of the cooling housing so as to allow the cooling water, introduced through the inlet pipe, to be supplied into the cooling housing.

The entrance guide device may include a first sealing bearing configured to surround an outer surface of a connection region of the inner cooling pipe and the outer cooling pipe, a first sealing door configured to isolate the interior of the combustion body structure from the outside, a second sealing bearing configured to surround an outer surface of the inner cooling pipe located inside the first sealing door, and a second sealing door configured to secondarily isolate the interior of the combustion body structure from the outside, along with the first sealing door.

The clinker remover may include a plurality of removal blades integrally protruding from an outer surface of the clinker cooler partially inserted into the combustion body structure so as to be arranged side by side, the blades being adapted to remove the clinkers generated at the grate by being rotated as the clinker cooler connected thereto is rotated.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a view illustrating an air cooled combustion furnace system according to the present invention;

FIG. 2 is a view illustrating a cross section of the air cooled combustion furnace system according to the present invention;

FIG. 3 is a view illustrating a cooling device of the air cooled combustion furnace system according to the present invention;

FIG. 4 is an exploded perspective view of FIG. 3;

FIG. 5 is a view illustrating the flow of air for cooling of a combustion furnace in the air cooled combustion furnace system according to the present invention;

FIG. 6 is a view illustrating important parts of the air cooled combustion furnace system according to the present invention;

FIG. 7 is a view illustrating a fuel supply device of the air cooled combustion furnace system according to the present invention;

FIG. 8 is a sectional view of FIG. 7;

FIG. 9 is an enlarged view illustrating the fuel supply device of the air cooled combustion furnace system according to the present invention;

FIG. 10 is a view illustrating a grate device of the air cooled combustion furnace system according to the present invention;

FIG. 11 is an exploded perspective view illustrating the grate device of the air cooled combustion furnace system according to the present invention;

FIG. 12 is a view illustrating a cross section of the grate device illustrated in FIG. 11;

FIG. 13 is a view illustrating important parts of the air cooled combustion furnace system according to the present invention;

FIG. 14 is a view illustrating other important parts of a graft and a turntable for assembly with the combustion furnace according to the present invention;

FIG. 15 is a view illustrating an assembly unit of the air cooled combustion furnace system according to the present invention;

FIG. 16A is a view illustrating an embodiment based on FIG. 15;

FIG. 16B is a view illustrating the embodiment of FIG. 16A;

FIG. 17A is a view illustrating another embodiment of FIGS. 16A and 16B;

FIG. 17B is a view illustrating the embodiment of FIG. 17A;

FIG. 18 is a view illustrating a clinker removal device of the air cooled combustion furnace system according to the present invention;

FIG. 19 is a view illustrating a cross section of the clinker removal device of the air cooled combustion furnace system according to the present invention;

FIG. 20 is a cross sectional view illustrating the use state of the clinker removal device according to the present invention;

FIG. 21 is a plan view illustrating the use state of the clinker removal device for the combustion furnace according to the present invention;

FIG. 22 is a view illustrating important parts of the clinker removal device according to the present invention; and FIG. 23 is a view illustrating an embodiment of the air cooled combustion furnace system according to the present invention.

DETAILED DESCRIPTION OF THE INVENTION

Hereinafter, exemplary embodiments of the present invention will be described in detail with reference to the accompanying drawings, in order to allow those skilled in the art to easily implement the present invention.

Note that, in the following detailed description, a technical configuration of an air cooled combustion furnace system (more particularly, a combustion body structure) which is capable of quantitatively distributing combustion air when supplying the air into a combustion furnace to generate heat energy for operation of a boiler via burning of a solid fuel, thereby accomplishing efficient cooling of the combustion furnace and stable supplying of preheated combustion air may be applied by way of example.

FIG. 1 is a view illustrating an air cooled combustion furnace system according to the present invention and FIG. 2 is a view illustrating a cross section of the air cooled combustion furnace system according to the present invention.

Referring to FIGS. 1 and 2, the air cooled combustion furnace system according to the present invention uses a solid fuel 10 acquired by compressing waste plastic generated at work or at home into a solid that is usable as a fuel.

The solid fuel 10 is introduced into a combustion body structure 100 and generates heat energy via combustion thereof. The generated heat energy is converted into energy to be used by the air cooled combustion furnace system.

At this time, combustion of the solid fuel 10 causes generation of high temperature heat of 1000° C. or more in the combustion body structure 100. This high temperature heat, however, may damage constituent elements in the vicinity of the combustion body structure 100.

For this reason, the air cooled combustion furnace system includes a cooling device 200 to cool the outer surface and the interior of the combustion body structure 100.

Here, the combustion body structure 100 and the cooling device 200 may be formed of steel or various other metals having high heat resistance. In particular, the combustion body structure 100 and the cooling device 200 may be fabricated via casing of a highly heat resistant metal, in order to minimize thermal deformation thereof.

The combustion body structure 100 internally defines a space into which the solid fuel 10 may be introduced and combusted.

That is, the combustion body structure 100 incorporates a hopper 150 to assist the solid fuel 10 in being introduced into the combustion body structure 100, and the solid fuel 10 introduced into the combustion body structure 100 through the hopper 150 is combusted to generate heat energy in the combustion space.

The cooling device 200 is integrally attached to the outer surface of the combustion body structure 100. The cooling device 20 is vertically divided into a plurality of stories such that air is distributed and introduced into the respective stories so as to cool the combustion body structure 100.

In addition, when the solid fuel 10 is combusted within the combustion body structure 100, a positive pressure is created within the combustion body structure 100. The positive pressure within the combustion body structure 100 causes heat to be easily transferred to constituent elements surrounding the combustion body structure 100.

Here, the cooling device 200 functions to cool the outer surface and the inner surface of the combustion body structure 100.

In addition, the cooling device 200 functions not only to prevent outward emission of heat transferred to the exterior and the interior of the combustion body structure 100, but also to cause air, more particularly, preheated air, to be introduced into the combustion body structure 100 so as to upwardly move combustion air within the combustion body structure 100.

Upward movement of the combustion air within the combustion body structure 100 may result in increased combustion efficiency and, consequently, increased energy conversion efficiency.

In addition, the air cooled combustion furnace system includes a negative pressure induction device 300 to control the interior pressure of the combustion body structure 100 because a high pressure within the combustion body structure 100 may cause transfer of heat to the constituent elements surrounding the combustion body structure 100, thereby causing thermal damage to the constituent elements.

That is, the negative pressure induction device 300 is used to maintain the interior of the combustion body structure 100 at a lower pressure than the atmospheric pressure at the outside of the combustion body structure 100.

The negative pressure induction device 300 is connected to the top of the combustion body structure 100 and functions to create a negative pressure within the combustion body structure 100 by suctioning air introduced into the combustion body structure 100 via operation of the cooling device 200. As the negative pressure induction device 300 enables smooth exhaust of air inside the combustion body structure 100, thereby maintaining the interior of the combustion body structure 100 at a negative pressure, it is possible to prevent damage to the inner and outer walls of a combustion furnace and constituent elements surrounding the combustion furnace due to a positive pressure operation.

The solid fuel 10 supplied into the combustion body structure 100 generates heat and steam while being combusted within the combustion body structure 100.

To supply the solid fuel 10 into the combustion body structure 100, a fuel supply device 400 is used to convey the solid fuel 10.

At this time, the fuel supply device 400 includes a conveyor 410 to convey the solid fuel 10 and a tubular cylinder 420 into which the solid fuel 10 conveyed from the conveyor 410 is introduced.

In addition, the fuel supply device 400 further includes a cylinder rod 430 configured to be partially inserted into the cylinder 420 to push and convey the solid fuel 10 introduced into the cylinder 420 via reciprocating movement thereof.

Consequently, the solid fuel 10 is conveyed through the fuel supply device 400 and introduced into the combustion body structure 100 through the hopper 150, thereby being combusted within the combustion body structure 100.

Once the solid fuel 10 has been introduced into the combustion body structure 100 through the hopper 150, the solid fuel 10 is supported by the upper surface of a grate device 500 during combustion thereof. The grate device 500 defines the inner bottom surface of the combustion body structure 100.

Here, the grate device 500 includes a grate 510 constructed by coupling a plurality of arc-shaped grate segments 512 to one another. The grate 510 supports the solid fuel 10 during combustion of the solid fuel 10 and defines the bottom surface of the combustion body structure 100.

The grate device 500 further includes a turntable 520 connected to the bottom of the grate 510, which is installed to surround the outer surface of the hopper 150, to rotate the grate 510.

The grate device 500 further includes a support body 530 configured to support the bottom of the turntable 520. The support body 530 is provided at the top thereof with rollers 551 to assist rotation of the turntable 520 and the lower surface of the support body 530 is supported by the ground.

Meanwhile, clinkers 30 as impurities are generated at the grate device 500 as the solid fuel 10 is combusted on the grate 510. To remove the clinkers 30, the air cooled combustion furnace system includes a clinker removal device 600 installed to communicate the interior of the combustion body structure 100 with the outside.

Hereinafter, the above-described constituent elements will be described in more detail.

FIG. 3 is a view illustrating the cooling device of the air cooled combustion furnace system according to the present invention and FIG. 4 is an exploded perspective view of FIG. 3.

Referring to FIGS. 3 and 4, the combustion body structure 100 incorporates the grate 510, which consists of the grate segments 512 coupled to one another to construct the bottom surface of the combustion body structure 100, the grate 510 serving to support the solid fuel 10 during combustion of the solid fuel 10.

The combustion body structure 100 further incorporates the turntable 520 connected to the bottom of the grate 510 to rotate the grate 510 and the hopper 150 located below the turntable 520 to vertically penetrate the grate 510 so as to supply the solid fuel 10 onto the grate 510.

An ash chamber 105 is formed in a space below the rims of the grate 510 and the turntable 520 such that ashes of the solid fuel 10 combusted on the grate 510 are delivered into and stored in the ash chamber 105.

The ash chamber 105 is provided with a discharge flap 107 to discharge the ashes of the solid fuel 10 introduced into the ash chamber 105 to the outside of the ash chamber 105.

The ash chamber 105 has a discharge hole 109 perforated in the bottom surface thereof to form an ash discharge passage. An ash container 103 is installed below the discharge hole 109 such that the ashes discharged from the ash chamber 105 through the discharge hole 109 may be stored in the ash container 103.

The discharge flap 107 installed to the ash chamber 105 is connected to the bottom of the turntable 520. Thereby, as the turntable 520 is rotated, the discharge flap 107 is rotated to guide the ashes inside the ash chamber 105 to the discharge hole 109, thereby allowing the ashes to be discharged outward from the combustion body structure 100 and be stored in the ash container 103.

Here, the grate 510 is downwardly inclined from the center of the hopper 150 toward the ash chamber 105, in order to allow the ashes of the combusted solid fuel 10 to be moved to the ash chamber 105 below the combustion body structure 100 while supporting the solid fuel 10 to ensure effective combustion thereof.

In addition, the grate 510 is constructed as the arc-shaped grate segments 512 are firmly coupled to one another.

At this time, the grate 510 defining the bottom surface of the combustion body structure 100 may be horizontally disposed and may be operated to adjust the input amount of the solid fuel according to the user's needs via various inclination angles of the fuel.

In particular, as the grate 510 is assembled by coupling the grate segments 512 to one another, a doughnut-shaped single grate 510 may be acquired.

In this way, even if the grate 510 is locally damaged due to high temperatures heat during combustion of the solid fuel 10, only the damaged grate segment(s) 512 may be separately replaced, which may reduce a cost of consumable constituent elements.

The turntable 520 is configured to rotate about the hopper 150 vertically inserted into the combustion body structure 100 while supporting the grate 510 disposed thereon.

The hopper 150 is configured to vertically penetrate the bottom center of the combustion body structure 100 from the outside of the combustion body structure 100.

The hopper 150 functions to supply the solid fuel 10 into the combustion body structure 100 from the outside of the combustion body structure 100.

Here, the grate 510 and the turntable 520 may be formed of various materials such as, for example, a highly heat resistant iron or metal.

Meanwhile, the cooling device 200 is configured to surround the outer wall of the combustion body structure 100 and includes a plurality of coolers connected to and stacked one above another from the bottom to the top of the combustion body structure 100 along the outer surface of the combustion body structure 100.

Specifically, the cooling device 200 includes a first cooler 210 and a second cooler 220 assembled to the top of the first cooler 210. The first cooler 210 is configured to supply air to the bottom of the combustion body structure 100 so as to cool the bottom of the combustion body structure 100. The second cooler 220 is configured to supply air so as to cool the lower outer surface of the combustion body structure 100.

In addition, the cooling device 200 further includes a third cooler 230 assembled to the top of the second cooler 220 and a fourth cooler 240 assembled to the top of the third cooler 230. The third cooler 230 has a vertical partition 202 to divide the interior of the third cooler 230 into two regions and is configured to allow air, introduced from the outside, to be directed to an inner lower region of the combustion body structure 100. The fourth cooler 240 also has a vertical partition 202 to divide the interior of the fourth cooler 240 into two regions and is configured to allow air, introduced from the outside, to be directed to a region between the inner upper region and the inner lower region of the combustion body structure 100.

In addition, the cooling device 200 further includes a fifth cooler 250 assembled to the top of the fourth cooler 240 and a sixth cooler 260 assembled to the top of the fifth cooler 250. The fifth cooler 250 has a vertical partition 202 to divide the interior of the fifth cooler 250 into two regions and is configured to allow air, introduced from the outside, to be circulated along the inner side and the outer side of the partition 202 so as to cool the outer surface of the combustion body structure 100. The sixth cooler 260 has a diagonal partition 202 to divide the interior of the sixth cooler 260 into two regions and further has a top opening 262. The sixth cooler 260 is shaped such that an inner diameter thereof is gradually reduced upward and is configured to allow air, introduced from the outside, to be circulated along the inner side and the outer side of the partition 202 so as to cool the outer surface of the combustion body structure 100.

The first, second, third, fourth, fifth, and sixth coolers 210, 220, 230, 240, 250 and 260 respectively take the form of a tube having a ring-shaped cross section so as to surround the outer wall of the combustion body structure 100 and to allow movement of air therein.

In particular, each of the third, fourth, fifth, and sixth coolers 230, 240, 250, and 260 has the partition 202 configured to vertically divide the interior of the corresponding cooler. As such, the air is introduced from the outer side of the partition 202 and moved to the inner side of the partition 202.

Here, the first, second, third, fourth, fifth and sixth coolers 210, 220, 230, 240, 250 and 260 are stacked one above another from the bottom to the top of the outer surface of the combustion body structure 100 and coupled to one another. In addition, the first, second, third, fourth, fifth and sixth coolers 210, 220, 230, 240, 250 and 260 are arranged in pairs at the outer surface of the combustion body structure 100.

At this time, the positions and the number of the first, second, third, fourth, fifth and sixth coolers 210, 220, 230, 240, 250 and 260 may be changed in various ways so long as they can provide effective cooling of the combustion body structure 100.

In addition, each of the first, second, third, fourth, fifth and sixth coolers 210, 220, 230, 240, 250 and 260 has an air inlet port 204 configured to receive air from the outside and supply the air into the combustion body structure 100.

The number of the coolers 210, 220, 230, 240, 250 and 260 may be changed according to the capacity of the combustion furnace or a target processing object.

In conclusion, the cooling device 200 takes the form of a stack including the first, second, third, fourth, fifth, and sixth coolers 210, 220, 230, 240, 250 and 260 stacked one above another in this sequence from the bottom of the outer wall of the combustion body structure 100.

In addition, by separately controlling the amount and velocity of air introduced through the air inlet ports 204 provided at the respective coolers, the first, second, third, fourth, fifth, and sixth coolers 210, 220, 230, 240, 250 and 260 sequentially stacked one above another may implement cooling of the combustion body structure 100 on a per section basis.

Each of the first, second, third, fourth, fifth, and sixth coolers 210, 220, 230, 240, 250 and 260 is constructed by assembling a plurality of plates with one another.

Owing to this plate assembly configuration, when the first, second, third, fourth, fifth, and sixth coolers 210, 220, 230, 240, 250 and 260 are locally damaged in use, only the damaged plate(s) may be simply replaced, which may maximize the lifespan of the first, second, third, fourth, fifth, and sixth coolers 210, 220, 230, 240, 250 and 260.

In addition, it will be appreciated that the first, second, third, fourth, fifth, and sixth coolers 210, 220, 230, 240, 250 and 260 may have various cross sectional shapes such as, for example, circular, oval and rectangular cross sectional shapes so long as they allow air, introduced from the outside, to be directed to and circulated along the combustion body structure 100 for the sake of efficient cooling.

In conclusion, the first, second, third, fourth, fifth, and sixth coolers 210, 220, 230, 240, 250 and 260 function to cool the combustion body structure 100 using outside air supplied through the air inlet ports 204 formed in the respective coolers.

A more detailed description related to the cooling of the combustion body structure 100 using the flow of air through the first, second, third, fourth, fifth, and sixth coolers 210, 220, 230, 240, 250 and 260 will follow.

Meanwhile, the negative pressure induction device 300 is connected to the top of the combustion body structure 100 and functions to outwardly discharge the air introduced through the cooling device 200 and exhaust gas generated in the combustion body structure 100 during combustion of the solid fuel 10 from the combustion furnace.

The negative pressure induction device 300 creates a negative pressure within the combustion body structure 100 by suctioning the air introduced into the combustion body structure 100 through the cooling device 200 and high pressure air caused by combustion of the solid fuel 10.

To this end, the negative pressure induction device 300 includes a flue 310 connected to the top of the combustion body structure 100 and a negative pressure generator 320 connected to the flue 310.

The flue 310 functions as a passage for movement of the interior air of the combustion body structure 100. The flue 310 may be formed of iron, a metal, or a fireproof material having high heat resistance to withstand high temperatures, and may have various shapes such as, for example, cylindrical and rectangular tubular shapes.

The negative pressure generator 320 is connected to the flue 310 and functions to suction the interior combustion gas of the combustion body structure 100.

Here, the negative pressure induction device 300 may serve to control the interior pressure of the combustion body structure 100 according to the user's needs, so as to minimize damage to constituent elements caused by the interior pressure of the combustion body structure 100.

FIG. 5 is a view illustrating the flow of air for cooling of the combustion furnace in the air cooled combustion furnace system according to the present invention.

Referring to FIG. 5, the combustion air, introduced into the first, second, third, fourth, fifth and sixth coolers 210, 220, 230, 240, 250 and 260 through the respective air inlet ports 204, is swirled at a high velocity along the outer wall of the combustion body structure 100 to thereby cool the combustion body structure 100.

At this time, the air introduced into the first, second, fifth and sixth coolers 210, 220, 250 and 260 serves to cool the combustion body structure 100 by being continuously circulated within the first, second, fifth and sixth coolers 210, 220, 250 and 260.

On the other hand, the air introduced into the third and fourth coolers 230 and 240 is first circulated within the third and fourth coolers 230 and 240 and then introduced into the combustion body structure 100 so as to cool the inner surface of the combustion body structure 100.

Specifically, the first cooler 210 allows air, directed to the top of the ash chamber 105 and the turntable 520, to be circulated within the first cooler 210, thereby cooling the ash chamber 105, the turntable 520 and the periphery thereof.

The second cooler 220 allows air above the horizontal turntable 520 and around the grate 51 to be circulated within the second cooler 220, thereby cooling a region above the turntable 520 and a region around the grate 510.

The third cooler 230 is vertically divided by the partition 202.

The partition 202 of the third cooler 230 is arranged to divide the interior of the third cooler 230 into two regions while forming an open top region. As such, the air introduced through the air inlet port 204 of the third cooler 230 is moved from the outer side of the partition 202 to the inner side of the partition 202 within the third cooler 230.

That is, the third cooler 230 has a dual structure in which the air introduced through the air inlet port 204 is first moved along the outer wall of the combustion body structure 100 at the outer side of the partition 202 corresponding to an outer region of the third cooler 230 and then moved to the inner side of the partition 202 corresponding to an inner region of the third cooler 230 through the open top region of the partition 202, which causes the air to be swirled at a high velocity along the outer wall of the combustion body structure 100.

Then, the air having passed through the third cooler 230 is introduced into the combustion body structure 100 through a guide path 206 that is a clearance formed in the bottom of the third cooler 230.

The air, introduced into the combustion body structure 100 through the guide path 206, supplies oxygen to the solid fuel 10 introduced through the hopper 150, thereby facilitating efficient combustion of the solid fuel 10 and cooling the interior of the combustion body structure 100.

In conclusion, the third cooler 230 functions not only to simultaneously cool regions inside and outside the grate 510 corresponding to the bottom of the combustion body structure 100 and to supply oxygen to the solid fuel 10.

Similar to the third cooler 230, the fourth cooler 240 is vertically divided by the partition 202.

The partition 202 of the fourth cooler 240 is arranged to divide the interior of the fourth cooler 240 into two regions while forming a bottom open region. As such, the air introduced through the air inlet port 204 of the fourth cooler 240 is moved from the outer side to the inner side of the partition 202 within the fourth cooler 240.

That is, the fourth cooler 240 has a dual structure in which the air introduced through the air inlet port 204 is first moved along the outer wall of the combustion body structure 100 at the outer side of the partition 202 corresponding to an outer region of the fourth cooler 240 and then moved to the inner side of the partition 202 corresponding to an inner region of the fourth cooler 240 through the open bottom region of the partition 202, which causes the air to be swirled at a high velocity along the outer wall of the combustion body structure 100.

Then, the air having passed through the fourth cooler 240 is introduced into the combustion body structure 100 through a guide path 206 that is a clearance formed in the top of the fourth cooler 240.

The air, introduced into the combustion body structure 100 through the guide path 206, is directed to a region above the hopper 150, thereby cooling the interior of the combustion body structure 100.

In particular, the third and fourth coolers 230 and 240 are configured to allow air introduced through the air inlet ports 204 to be circulated in the interior of the third and fourth coolers 230 and 240 and then be introduced into the combustion body structure 100.

In conclusion, the third cooler 230 simultaneously cools the grate 510 defining the bottom of the combustion body structure 100, a region around the hopper 150, and the interior and the exterior of the combustion body structure 100, and the fourth cooler 240 simultaneously cools the interior and the exterior of the combustion body structure 100 at the middle of the combustion body structure 100.

In particular, the third cooler 230 and the fourth cooler 240 are internally provided with eddy pieces 208 to guide diagonal air movement. The eddy pieces 208 allow air, introduced into the third and fourth coolers 230 and 240 from the outside, to be swirled within the third and fourth coolers 230 and 240.

Here, although the eddy pieces 208 are described as being provided at the third and fourth coolers 230 and 240, the eddy pieces 208 may be arranged in the first, second, fifth and sixth coolers 210, 220, 250 and 260 according to the user's needs, in order to allow the combustion body structure 100 to be cooled via smooth and high speed movement of air.

Similar to the fourth cooler 240, the fifth cooler 250 is vertically divided by the partition 202.

The partition 202 of the fifth cooler 250 is arranged to divide the interior of the fifth cooler 250 into two regions while forming a bottom or top open region. As such, the air introduced through the air inlet port 204 of the fifth cooler 250 is moved from the outer side to the inner side of the partition 202 within the fifth cooler 250.

That is, the fifth cooler 250 has a dual structure in which the air introduced through the air inlet port 204 is first moved along the outer wall of the combustion body structure 100 at the outer side of the partition 202 corresponding to an outer region of the fifth cooler 250 and then moved to the inner side of the partition 202 corresponding to an inner region of the fifth cooler 250 through the open top or bottom region of the partition 202, which causes the air to be swirled at a high velocity along the outer wall of the combustion body structure 100.

In this way, the fifth cooler 250 cools a region around the upper portion of the combustion body structure 100 by allowing air to be moved around the outer wall of the upper portion of the combustion body structure 100.

Similar to the fifth cooler 250, the sixth cooler 250 is vertically divided by the partition 202.

The partition 202 of the sixth coolers 260 is arranged to divide the interior of the sixth cooler 260 into two regions while forming an open bottom or top region. As such, the air introduced through the air inlet port 204 of the sixth cooler 260 is moved from the outer side to the inner side of the partition 202 within the sixth cooler 260.

In particular, the partition 202 formed at the six cooler 260 has a shape corresponding to a shape of the six cooler 260 and is diagonally arranged so as to be inwardly inclined toward the top of the combustion body structure 100.

In addition, the sixth cooler 260 is provided with the top opening 262, the inner diameter of which is gradually reduced upward, and cools the outer surface of the combustion body structure 100 by allowing the introduced air to be circulated along the inner side and the outer side of the partition 202.

In addition, the sixth cooler 260 has a dual structure in which the air introduced through the air inlet port 204 is first moved along the outer wall of the combustion body structure 100 at the outer side of the partition 202 corresponding to an outer region of the sixth cooler 260 and then moved to the inner side of the partition 202 corresponding to an inner region of the sixth cooler 260 through the open top or bottom region of the partitions 202, which causes the air to be swirled at a high velocity along the outer wall of the combustion body structure 100.

In this way, the sixth cooler 260 cools a region around the uppermost portion of the combustion body structure 100 by allowing air to be moved around the outer wall of the uppermost portion of the combustion body structure 100.

In conclusion, air supplied to the first, second, fifth and sixth coolers 210, 220, 250 and 260 is continuously circulated along the outer wall of the combustion body structure 100, thereby cooling the exterior of the combustion body structure 100 and constituent elements surrounding the combustion body structure 100.

In addition, air supplied to the third and fourth coolers 230 and 240 is moved along the outer wall of the combustion body structure 100 and introduced into the combustion body structure 100, thereby simultaneously cooling the exterior of the combustion body structure 100, the constituent elements surrounding the combustion body structure 100 and the interior of the combustion body structure 100.

In particular, once the air supplied to the third and fourth coolers 230 and 240 has been introduced into the combustion body structure 100, the air cools the interior of the combustion body structure 100 and, thereafter, is discharged from the combustion body structure 100 by the negative pressure induction device 300.

As mentioned above, the negative pressure induction device 300 includes the flue 310 connected to the top of the combustion body structure 100 and the negative pressure generator 320 connected to the flue 310.

Here, once the air supplied from the third and fourth coolers 230 and 240 has been introduced into the combustion body structure 100 and used to cool the combustion body structure 100, the negative pressure generator 320 suctions the interior air of the combustion body structure 100 so as to discharge the air to the outside of the combustion body structure 100 through the flue 310.

FIG. 6 is a view illustrating important parts of the air cooled combustion furnace system according to the present invention.

Referring to FIG. 6 with reference to FIG. 5, the inner diameter of the first and second coolers 210 and 220 is greater than the inner diameter of the third and fourth coolers 230 and 240 and, in turn, the inner diameter of the third and fourth coolers 230 and 240 is greater than the inner diameter of the fifth and sixth coolers 250 and 260.

The first, second, third, fourth, fifth and sixth coolers 210, 220, 230, 240, 250 and 260 as described above are given by way of example and may be changed in design according to operation conditions or states, and the inner diameters of the first, second, third, fourth, fifth and sixth coolers 210, 220, 230, 240, 250 and 260 may be changed in various ways according to determined design values.

The combustion body structure 100 as described above is gradually reduced in width from the bottom to the top.

As such, in the combustion body structure 100 and the cooling device 200 constructed via assembly of a plurality of plates, upper plates may be coupled to lower plates so as to surround the lower plates, which ensures hermetic sealing of the interior of the combustion body structure 100.

The guide paths 206, which are formed in the bottom of the third cooler 230 and the top of the fourth cooler 240, serve to guide the air, moving along the outer surface of the combustion body structure 100 and the partitions 202 of the third and fourth coolers 230 and 240, so as to be introduced into the combustion body structure 100.

Each guide path 206 may be elongated in the movement direction of air introduced into the cooling device 200 through the air inlet port 204.

The guide path 206 functions to facilitate introduction of the air into the combustion body structure 100.

In addition, the eddy pieces 208, which are formed inside the third cooler 230 and the fourth coolers 240, serve to guide diagonal air movement so as to allow air, introduced into the third and fourth coolers 230 and 240 from the outside, to be swirled within the third and fourth coolers 230 and 240.

The eddy pieces 208 function to cause air to be swirled at a high speed within the third and fourth coolers 230 and 240 and to effectively cool the interior and the exterior of the combustion body structure 100 by creating a strong swirl of air when the air is introduced from the third and fourth coolers 230 and 240 to the combustion body structure 100.

FIG. 7 is a view illustrating the fuel supply device of the air cooled combustion furnace system according to the present invention and FIG. 8 is a sectional view of FIG. 7.

Referring to FIGS. 7 and 8, the solid fuel 10 is supplied into the combustion body structure 100 and generates heat and steam by being combusted within the combustion body structure 100.

To supply the solid fuel 10 to the combustion body structure 100, the fuel supply device 400 is used to convey the solid fuel 10.

The fuel supply device 400 includes the conveyor 410 to convey the solid fuel 10 and the tubular cylinder 420 into which the solid fuel 10 conveyed from the conveyor 410 is introduced.

In addition, the fuel supply device 400 further includes the cylinder rod 430 partially inserted into the cylinder 420 to push and convey the solid fuel 10 introduced into the cylinder 420 via reciprocating movement thereof.

Consequently, the solid fuel 10 is conveyed through the fuel supply device 400 and introduced into the combustion body structure 100 through the hopper 150, thereby being combusted within the combustion body structure 100.

In addition, the solid fuel 10 is conveyed from the conveyor 410 to the tubular cylinder 420.

Once the solid fuel 10 has been introduced into the cylinder 420, the cylinder rod 430 partially inserted into the cylinder 420 is operated to push and convey the solid fuel 10 introduced into the cylinder 420 by reciprocating from the outside to the interior of the cylinder 420.

The solid fuel 10 conveyed through the cylinder 420 by the cylinder rod 430 is conveyed to the hopper 150 extending upward from the cylinder 420.

The top of the hopper 150 is inserted into the combustion body structure 100 in which the solid fuel 10 is combusted. As such, the hopper 150 functions to supply the solid fuel 10 into the combustion body structure 100.

Meanwhile, the conveyor 410 includes a belt 412 to convey the solid fuel 10 disposed on the upper surface thereof, a pulley 414 connected to the belt 412 to rotate the belt 412, and a motor 416 to transmit power to the pulley 414.

The motor 416 connected to the pulley 414 is operated upon receiving power and functions to rotate the pulley 414.

Here, the belt 412 functions to convey the solid fuel 10 by being circulated in the rotation direction of the pulley 414 connected thereto.

The conveyor 410 has a frame 411 located around the side surface of the belt 412, the frame 411 being erected on the ground so as to be spaced apart from the belt 412.

In addition, the conveyor 410 includes separation preventing plates 413 vertically formed at the rims of the frame 41 in the longitudinal direction of the belt 412 to prevent the solid fuel 10 from being separated from the belt 412.

The separation preventing plates 413 function to prevent the solid fuel 10 disposed on the belt 412 from being separated from both lateral sides of the belt 412.

At this time, although the frame 411 and the separation preventing plates 413 are spaced apart from the belt 412 so as not to interfere movement of the belt 412, the frame 411 and the separation preventing plates 413 may be located close to the belt 412 to the maximum extent, in order to prevent the solid fuel 10 disposed on and conveyed by the belt 412 from being separated from the belt 412.

The frame 411 may support the separation preventing plates 413 and may also support the motor 416 disposed thereon according to the user's needs.

In addition, the frame 411 may have various other shapes so long as the frame 411 supports the separation preventing plates 413 and is spaced apart from the belt 412 so as to prevent the solid fuel 10 from being separated from the belt 412 without interfering operation of the belt 412.

Meanwhile, the solid fuel 10 supplied from the conveyor 410 is conveyed through the tubular cylinder 420.

The cylinder 420 is composed of a linear pipe 422 and a curvilinear pipe 426.

The linear pipe 422 includes a collection chamber 424 providing a space in which the solid fuel 10 supplied from the conveyor 410 is collected. The curvilinear pipe 426 is provided at the inner surface thereof with rotation guide pieces 428 to guide rotation and movement of the solid fuel 10.

Here, the belt 412 of the conveyor 410 is positioned above the collection chamber 424 and the collection chamber 424 has a top opening, in order to allow the solid fuel 10 to fall into the collection chamber 424 through the top opening.

With this configuration, the solid fuel 10, conveyed on the upper surface of the belt 412, falls from the belt 412 to thereby be supplied into the collection chamber 424.

Once the solid fuel 10 has been conveyed into the cylinder 420, the solid fuel 10 is again conveyed within the cylinder 420 by the cylinder rod 430.

As described above, the cylinder 420 is composed of the linear pipe 422, which linearly extends from the collection chamber 424 and internally defines a longitudinal bore, and the curvilinear pipe 426 which extends from the linear pipe 422 and internally defines a curvilinear bore.

The cylinder rod 430 is partially inserted into the cylinder 420 to push and convey the solid fuel 10 introduced into the cylinder 420 by reciprocating from the outside to the interior of the cylinder 420.

To this end, the cylinder rod 430 includes a pressure rod 440 which is laterally inserted into the cylinder 420 from the outside to apply pressure to the solid fuel 10, so as to allow the solid fuel 10 supplied from the conveyor 410 to be densely received within the cylinder 420.

In addition, the cylinder rod 430 includes a conveyance rod 450 configured to reciprocate in the longitudinal direction of the cylinder 420 so as to convey the solid fuel 10 in the longitudinal direction of the cylinder 420 while applying pressure to the solid fuel 10.

The pressure rod 440 includes a pressure plate 442 configured to apply pressure to the solid fuel 10 while coming into close contact therewith, and the conveyance rod 450 includes a conveyance pusher 452 to convey the solid fuel 10 while coming into close contact therewith.

That is, the pressure rod 440 and the conveyance rod 450 horizontally reciprocate to intersect each other at an angle of 90 degrees within the collection chamber 424 defined in the cylinder 420.

The collection chamber 424 has openings for introduction of the pressure rod 440 and the conveyance rod 450, so as to allow the pressure rod 440 and the conveyance rod 450 to be smoothly movable into the collection chamber 424.

The openings of the collection chamber 424, through which the pressure rod 440 and the conveyance rod 450 are inserted, may have a shape corresponding to the outer diameters of the pressure rod 440 and the conveyance rod 450, in order to prevent leakage of the solid fuel 10 from the collection chamber 424.

In addition, the openings of the collection chamber 424, through which the pressure rod 440 and the conveyance rod 450 are inserted, may be provided with a rubber packing (not illustrated) or a silicon packing (not illustrated) to prevent leakage of the solid fuel 10 as needed.

Here, a more detailed description related to the pressure rod 440 and the conveyance rod 450 will follow.

Meanwhile, the solid fuel 10, conveyed through the linear pipe 422 and the curvilinear pipe 426 of the cylinder 420 via application of pressure by the pressure rod 440 and the conveyance rod 450, is introduced into the hopper 150 connected to the top of the curvilinear pipe 426.

At this time, the bottom of the hopper 150 is connected to the top of the curvilinear pipe 426 at the outside of the combustion body structure 100 and the top of the hopper 150 is accommodated in the combustion body structure 100.

The hopper 150 has a wider upper portion and a narrower lower portion and is open at the top thereof.

The hopper 150 is provided at the inner surface thereof with spirally protruding rotation induction pieces 155 to allow the solid fuel 10, located at the inner wall of the hopper 150 among the solid fuel 10 supplied from the curvilinear pipe 426, to be smoothly conveyed to the top of the hopper 150.

In particular, similar to the hopper 150, the curvilinear pipe 426 of the cylinder 420 extending to the hopper 150 is configured such that the inner diameter of a lower end of the curvilinear pipe 426 connected to the linear pipe 422 is smaller than the inner diameter of an upper end of the curvilinear pipe 426.

That is, the curvilinear pipe 426 may be gradually increased in the inner diameter thereof from the bottom to the top of a vertical upright portion thereof.

The spirally protruding rotation induction pieces 155 function to guide the solid fuel 10 so as to allow the solid fuel 10 to be smoothly conveyed to the top of the hopper 150.

Then, the solid fuel 10, discharged from the open top of the hopper 150, is introduced into the combustion body structure 100.

FIG. 9 is an enlarged view illustrating the fuel supply device of the air cooled combustion furnace system according to the present invention.

Referring to FIG. 9 with reference to FIG. 7, the solid fuel 10, supplied from the belt 412 of the conveyor 410 to the collection chamber 424, is pressed by the pressure rod 440 and the conveyance rod 450 and then conveyed to the hopper 150 through the linear pipe 422 and the curvilinear pipe 426 of the cylinder 420.

At this time, the outer surface of the belt 412 may be covered with an anti-contamination layer 418 formed of rubber or silicon. The anti-contamination layer 418 is detachably attached to the upper surface of the belt 412 in order to prevent the outer surface of the belt 412 from being contaminated by the solid fuel 10.

The anti-contamination layer 418 of the belt 412 extends to a gap between the frame 411 and the belt 412, thereby preventing leakage of the solid fuel 10 through the gap.

Considering the conveyance process as described above, the solid fuel 10 supplied into the collection chamber 424 is pressed by the pressure plate 442 of the pressure rod 440 to thereby be brought into close contact with the wall surface of the collection chamber 424.

Once the solid fuel 10 has been densely received in the collection chamber 424, the solid fuel 10 is again pressed by the conveyance pusher 452 of the conveyance rod 450 and conveyed to the linear pipe 422.

When the solid fuel 10 is continuously introduced into the linear pipe 422 in a state in which the previously conveyed solid fuel 10 has been accumulated in the linear pipe 422, the previously conveyed solid fuel 10 inside the linear pipe 422 is pushed by the following solid fuel 10 to thereby be conveyed to the curvilinear pipe 426.

At this time, the curvilinear pipe 426 is provided at the inner surface thereof with spirally protruding rotation guide pieces 428 to allow the solid fuel 10 adhered to the wall surface of the curvilinear pipe 426 to be smoothly conveyed upward.

The solid fuel 10, located at the inner wall of the curvilinear pipe 426, is rotated and moved upward along the inner wall of the curvilinear pipe 426 by the rotation guide pieces 428, thereby being conveyed to the hopper 150 connected to the top of the curvilinear pipe 426.

Since the top of the hopper 150 is located inside the combustion body structure 100, the solid fuel 10 is supplied into the combustion body structure 100 through the open top of the hopper 150.

Specifically, the solid fuel 10, supplied from the conveyor 410, is collected in the collection chamber 424.

At this time, the solid fuel 10 is densely received by the pressure plate 442 connected to the pressure rod 440 that is partially inserted into the collection chamber 424.

Once the solid fuel 10 has been densely received, the conveyance pusher 452, connected to the conveyance rod 450 that is introduced into the collection chamber 424 in the longitudinal direction of the linear pipe 422, applies pressure to the solid fuel 10 so as to convey the solid fuel 10 into the linear pipe 422.

The inner surface of the pressure plate 442 and the inner surface of the collection chamber 424 facing each other have an oval cross sectional shape.

Since the conveyance pusher 452 has a contour corresponding to the shape of the inner surface of the collection chamber 424 and the inner surface of the pressure plate 442, when the pressure plate 442 applies pressure to the solid fuel 10, the conveyance pusher 452 may reciprocate between the inner surfaces of the collection chamber 424 and the pressure plate 442.

That is, the contour of the conveyance pusher 452 corresponds to the assembled shape of the inner surface of the pressure plate 442 and the inner surface of the collection chamber 424 facing each other.

In addition, the inner surface of the pressure plate 442 and the inner surface of the collection chamber 424 may have various other shapes and, in turn, the contour of the conveyance pusher 452 may be changed to correspond to the shape of the inner surfaces.

In conclusion, in a state in which the pressure plate 442 applies pressure to the solid fuel 10 to allow the solid fuel 10 to be densely located at the facing wall surface of the collection chamber 424, the conveyance pusher 452 passes through between the wall surface of the collection chamber 424 and the pressure plate 442 so as to convey the densely received solid fuel 10 to the linear pipe 422.

In such a state, the solid fuel 10 continuously introduced into the collection chamber 424 is again pressed and densely accumulated by the pressure plate 442 and, thereafter, is conveyed to the linear pipe 422 by pressure applied to the conveyance pusher 452.

Once the solid fuel 10 has been accumulated in the linear pipe 422, the solid fuel 10 is conveyed to the curvilinear pipe 426 connected to the linear pipe 422.

Likewise, once the solid fuel 10 has been accumulated in the curvilinear pipe 426, the solid fuel 10 inside the curvilinear pipe 426 is conveyed to the hopper 150 by an additional solid fuel 10 pushed from the collection chamber 424.

As described above, the hopper 150 is provided at the inner wall surface thereof with the spirally protruding rotation induction pieces 155 to allow the solid fuel 10, located at the inner wall surface of the hopper 150, to be moved upward along the inner wall of the hopper 150.

The solid fuel 10, introduced into the hopper 150, is supplied to the combustion body structure 100 after passing through the open top of the hopper 150.

FIG. 10 is a view illustrating the grate device of the air cooled combustion furnace system according to the present invention, FIG. 11 is an exploded perspective view illustrating the grate device of the air cooled combustion furnace system according to the present invention, and FIG. 12 is a view illustrating a cross section of the grate device illustrated in FIG. 11.

Referring to FIGS. 10 to 12, when the solid fuel 10 is introduced into the combustion body structure 100 through the hopper 150, the solid fuel 10 is combusted while being supported by the upper surface of the grate device 500 defining the inner bottom surface of the combustion body structure 100.

Here, the grate device 100 includes the grate 510 constructed by coupling the arc-shaped grate segments 512 to one another. The grate 510 supports the solid fuel 10 during combustion of the solid fuel 10 and defines the bottom surface of the combustion body structure 100.

The grate device 500 further includes the turntable 520 connected to the bottom of the grate 510, which is installed to surround the outer surface of the hopper 150, to rotate the grate 510.

The grate device 500 further includes the support body 530 configured to support the bottom of the turntable 520. The support body 530 is provided at the top thereof with the rollers 551 to assist rotation of the turntable 520 and the lower surface of the support body 530 is supported by the ground.

Here, the rollers 551 are provided at the top of the support body 530 so as to come into close contact with the bottom of the turntable 520. As such, the rollers 551 function to facilitate smooth rotation of the turntable 520 and to support the turntable 520 so as to enable distribution of the weight of the turntable 520.

A more detailed description related to the rollers 551 will follow.

Meanwhile, the grate segments 512 include spiral guide protrusions 514 to guide the solid fuel 10 so as to be moved outward from the inner side of the grate 510 during combustion of the solid fuel 10.

As such, the solid fuel 10, disposed on the grate segments 512, is slowly moved outward from the inner side of the grate 510 along the guide protrusions 514 via rotation of the grate 510 as the turntable 520 connected to the grate 510 is rotated, which enables complete combustion of the solid fuel 10.

In particular, since the grate segments 512 are configured to overlap one another, even if the grate segments 512 are locally damaged by high temperatures generated during combustion of the solid fuel 10, a cost of consumable constituent elements may be reduced via selective replacement of the damaged segment(s).

In addition, to control the combustion time of the solid fuel 10, the grate 510 may be inclined, which enables control in the movement time of the solid fuel 10 along the grate segments 512.

Thereby, the combustion time of the solid fuel 10 at the upper surface of the grate 510 may be controlled to various values according to the user's needs, which may optimize the combustion efficiency of the solid fuel 10.

Meanwhile, the turntable 520 is composed of an upper turntable 522 configured to come into close contact with the bottom of the grate 510 and a lower turntable 524 configured to support the upper turntable 522 disposed thereon.

In addition, the turntable 520 further includes a power mechanism 525 including a rack gear 521 supported by the bottom of the lower turntable 524 and a pinion gear 523 connected to the rack gear 521 to transmit rotational power.

In conclusion, the power mechanism 525 causes rotation of the pinion gear 523 and, consequently, movement of the rack gear 521. As the rack gear 521 is moved, the lower turntable 524 is rotated.

Subsequently, as the lower turntable 524 is rotated, the upper turntable 522 connected to the lower turntable 524 is rotated, causing the grate 510 supported on the upper turntable 522 to be rotated.

In particular, the upper turntable 522 includes a fireproof layer 526 to prevent heat conduction from the grate 510 to the bottom of the upper turntable 522.

The fireproof layer 526 functions to prevent damage to constituent elements below the upper turntable 522 due to heat of the solid fuel 10 being combusted on the grate 510.

Here, the fireproof layer 526 may be formed of a material that is resistant to high temperatures so as to maintain rigidity thereof without being softened at high temperatures of at least 1000° C. and is also resistant to chemical actions.

Considering a configuration of the power mechanism 525 to rotate the lower turntable 524, the power mechanism 525 includes a rod-shaped rotating shaft 527 rotatably coupled to the pinion gear 523.

The power mechanism 525 further includes a connection gear 528 to rotate the rotating shaft 527 and a motor 529 to rotate the connection gear 528 by transmitting power to the connection gear 528.

In conclusion, the power mechanism 525 functions to rotate the turntable 520.

Although the configuration of the power mechanism 525 according to one embodiment has been described above, various other constituent elements may be used so long as they can smoothly rotate the turntable 520 so as to rotate the grate 510.

The hopper 150 is disposed on the support body 530 so as to vertically penetrate the turntable 520 and the grate 510.

The hopper 150 functions as a passage for movement of the solid fuel 10.

In addition, an auxiliary body 534 is disposed on the support body 530 and fixed to the hopper 150 so as to surround the outer surface of the hopper 150. The auxiliary body 534 is provided at the outer surface thereof with multiple stepped portions 532 to support the inner rims of the turntable 520 and the grate 510.

The upper turntable 522 and the lower turntable 524, which are stacked one above another, are partially disposed on and supported by the stepped portions 532 formed at upper and lower positions of the outer surface of the auxiliary body 534.

In particular, the auxiliary body 534 is integrally formed with the outer surface of the hopper 150 and comes into close contact with the grate 510 and the turntable 520.

With this configuration, there are no spaces between the grate 510, the turntable 520, the hopper 150 and the auxiliary body 534, which may prevent leakage of heat of the grate 510 through a gap between the grate 510 and the auxiliary body 534.

In addition, a cylindrical up-and-down moving pipe 536 connected to a lower portion of the hopper 150 is disposed on the support body 530, and a height regulator 540 is fixed to the outer circumference of the up-and-down moving pipe 536 so as to upwardly or downwardly move the up-and-down moving pipe 536.

At this time, a bearing 538 is interposed between the up-and-down moving pipe 536 and the hopper 150. When the turntable 520 is rotated, the hopper 150 connected to the turntable 520 via the bearing 538 is rotatable.

The up-and-down moving pipe 536 connected to the bottom of the hopper 150 is not involved in rotation of the hopper 150 due to the provision of the bearing 538.

Here, the height regulator 540 is located to support the up-and-down moving pipe 536 in a float state and, thus, functions to upwardly or downwardly move the up-and-down moving pipe 536.

A more detailed description related to the height regulator 540 will follow.

FIG. 13 is a view illustrating important parts of the air cooled combustion furnace system according to the present invention.

Referring to FIG. 13 with reference to FIGS. 10 to 12, the height regulator 540 includes an elevating plate 542 horizontally connected to the up-and-down moving pipe 536 and an inclined plate 544 located below the elevating plate 542, the inclined plate 544 having an outwardly downwardly inclined side cross section.

The height regulator 540 further includes a moving piece 546 located below the inclined plate 544, the moving piece 546 having an outwardly upwardly inclined side cross section so as to upwardly or downwardly move the inclined plate 544 by being moved inside the inclined plate 544.

In addition, the height regulator 540 further includes a screw bolt 548 configured to be rotated inside the moving piece 546 so as to move a position of the moving piece 546, and a stopper 549 protruding from the outer surface of the screw bolt 548 to control movement of the moving piece 546 on the screw bolt 548.

The height regulator 540 is operated to upwardly or downwardly move the elevating plate 542 as the moving piece 546 inside the inclined plate 544 reciprocates inward and outward of the inclined plate 544 by the screw bolt 548.

At this time, the lower surface of the inclined plate 544 comes into contact with the upper surface of the moving piece 546.

That is, when the screw bolt 548 is rotated in a given direction, the moving piece 546 is moved inward of the inclined plate 544. When the screw bolt 548 is rotated in an opposite direction, the moving piece 546 is moved outward of the inclined plate 544.

Specifically, since the inclined plate 544 and the moving piece 546 have contrary inclination angles, when the moving piece 546 is moved inward of the inclined plate 544, the contrary inclination angles causes upward movement of the elevating plate 542.

When the moving piece 546 is moved outward of the inclined plate 544, the contrary inclination angles causes downward movement of the elevating plate 542.

Here, the outward movement distance of the moving piece 546 from the inclined plate 544 is delimited by the stopper 549 protruding from the outer surface of the screw bolt 548.

When the elevating plate 542 is upwardly or downwardly moved via operation of the moving piece 546, the inclined plate 544 and the screw bolt 548, the up-and-down moving pipe 536 connected to the elevating plate 542 is also upwardly or downwardly moved.

In particular, when the up-and-down moving pipe 536 is upwardly or downwardly moved, the hopper 150, supported by the up-and-down moving pipe 536, is also upwardly or downwardly moved.

As a result, the auxiliary body 534 fixed to the outer surface of the hopper 150 and the turntable 520 and the grate 510 connected to the outer surface of the auxiliary body 534 are upwardly or downwardly moved together.

Meanwhile, as described above, the turntable 520 is composed of the upper turntable 522 configured to come into close contact with the bottom of the grate 510 and the lower turntable 524 configured to support the upper turntable 522 disposed thereon.

In addition, the turntable 520 further includes the power mechanism 525 including the rack gear 521 supporting the bottom of the lower turntable 524 and the pinion gear 523 connected to the rack gear 521 to transmit rotational power.

The power mechanism 525 includes the rod-shaped rotating shaft 527 rotatably coupled to the pinion gear 523.

The power mechanism 525 further includes the connection gear 528 to rotate the rotating shaft 527 and the motor 529 to rotate the connection gear 528 by transmitting power to the connection gear 528.

At this time, positions and shapes of the connection gear 528, the rotating shaft 527, and the pinion gear 523 may be changed in various ways according to the position of the motor 529, and a plurality of connection gears 528 may be connected to one another via a chain.

In addition, the connection gear 528 may be replaced with a pulley. As such, a belt may be connected to the pulley to enable rotation of the rotating shaft 527 via interaction with the pulley.

Meanwhile, the rack gear 521 is located to support the bottom of the lower turntable 524 and a sealing piece 533 is provided at the upper outer side of the lower turntable 524.

The sealing piece 533 is configured to come into close contact with a sealing plate 535 that surrounds the rack gear 521 and the bottom of the lower turntable 524.

Specifically, the sealing plate 535 is provided the inner surface thereof with a sealing groove 537 such that the sealing piece 533 comes into close contact with the sealing groove 537. A packing 539 having high heat resistance and elasticity is fitted in the sealing groove 537.

Accordingly, the sealing piece 533 is received in the sealing groove 537 so as to come into close contact with the packing 539.

In this way, it is possible to prevent outward heat conduction from a space between the bottom of the grate 510 and the lower turntable 524 to the sealing plate 535.

Consequently, the sealing plate 535 is configured to come into contact with the lower turntable 524 and functions to prevent leakage of heat from the grate 510 and the lower turntable 524.

FIG. 14 is a view illustrating other important parts of the graft and the turntable for assembly with the combustion furnace according to the present invention.

Referring to FIG. 14 with reference to FIGS. 10 to 12, the support body 530 is located below the lower turntable 524 constituting a lower portion of the turntable 520 and serves to support the lower turntable 524.

The lower surface of the support body 530 is supported by the ground.

The rollers 551 to assist rotation of the turntable 520 are arranged on the support body 530 so as to support the turntable 520.

Here, the rollers 551 come into close contact with the lower surface of the lower turntable 524, thereby facilitating smooth rotation of the lower turntable 524 and supporting the lower turntable 524 to enable distribution of the weight of the lower turntable 524.

To this end, the rollers 551 include a plurality of auxiliary rollers 552 arranged at outer positions of the lower surface of the lower turntable 524 to assist rotation of the lower turntable 524 and a plurality of main rollers 554 arranged at inner positions of the lower surface of the lower turntable 524 to assist rotation of the lower turntable 524.

In addition, the support body 530 includes auxiliary support pieces 556 to support the auxiliary rollers 552 fixed thereon and main support pieces 558 to support the main rollers 554 fixed thereon.

Specifically, the auxiliary rollers 552 supported on the auxiliary support pieces 556 are distributed in all directions and located at the outer positions of the lower surface of the lower turntable 524 to support an outer rim region of the lower turntable 524, the auxiliary rollers 552 being rotated according to rotation of the lower turntable 524.

The main rollers 554 supported on the main support pieces 558 are distributed in all directions and located at the inner positions of the lower surface of the lower turntable 524 to support an inner rim region of the lower turntable 524, the main rollers 554 being rotated according to rotation of the lower turntable 524.

Consequently, the rollers 551 are arranged to come into contact with the lower turntable 524 and function to distribute the weight of the grate 510 and the turntable 520.

FIG. 15 is a view illustrating an assembly unit of the air cooled combustion furnace system according to the present invention.

Referring to FIG. 15, to define the combustion furnace having a combustion space into which the solid fuel 10 is introduced to produce heat energy via combustion thereof, a plurality of assembly units 110 is assembled with one another to construct the inner wall of the combustion furnace.

In addition, a connection unit 120 is provided to enable separable coupling of the assembly units 110.

The combustion body structure 100 is configured to surround the assembly units 110 and the connection unit 120 and to define the outer wall of the combustion furnace. The combustion body structure 100 incorporates the grate 510 configured to support the solid fuel 10 and the annular turntable 520 located below the grate 510 to enable rotation of the grate 510.

Here, the assembly units 110 include assembly plates 112 configured to be assembled with one another.

The connection unit 120 includes coupling bosses 122 formed at an upper portion of one assembly plate 112 and coupling recesses 124 formed at a lower portion of the other assembly plate 112' for insertion of the coupling bosses 122, to enable separable coupling of the assembly plates 112 and 112'.

The assembly plates 112 and 112' are provided with left and right ends thereof with stepped coupling portions 114 to allow the different assembly plates 112 and 112' to horizontally overlap and be assembled with each other.

In addition, the assembly plates 112 and 112' are further provided at upper and lower ends thereof with horizontally protruding coupling flanges 116 to allow the different assembly plates 112 and 112' to be vertically stacked one above another.

The coupling flanges 116 may be omitted according to a position of the corresponding assembly plate 112.

In addition, the connection unit 120 further includes a plurality of nut holes 126 formed in corresponding positions of the rims of the respective assembly plates 112 and 112' to assist separation or coupling of the different assembly plates 112 and 112' and fastening bolts 128 to be separably fastened to the nut holes 126.

Consequently, the assembly units 110 construct the inner wall of the combustion furnace as the assembly plates 112 and 112' are horizontally and vertically connected to one another via the connection unit 120.

The assembly plates 112 and 112' as described above may basically have a gently curved shape and some portions of the respective assembly plates 112 and 112' may have slightly different shapes according to the shapes of other constituent elements.

Likewise, the coupling bosses 122 of the connection unit 120 may have various shapes so long as they ensure firm coupling of the assembly plates 112 and 112', and the coupling recesses 124 for insertion of the coupling bosses 122 may have a shape corresponding to the coupling bosses 122.

The assembly units 110 and the connection unit 120 may be formed of various materials such as, for example, a highly heat resistant iron or metal.

FIG. 16A is a view illustrating an embodiment based on FIG. 15 and FIG. 16B is a view illustrating the embodiment of FIG. 16A.

Referring to FIG. 16A, the assembly unit 110 includes the assembly plates 112 and 112' configured to be assembled with each other.

The connection unit 120 includes the coupling bosses 122 formed at the upper portions of the assembly plates 112 and 112' and the coupling recesses 124 formed at the lower portions of the assembly plates 112 and 112' for insertion of the coupling bosses 122, to enable separable coupling of the assembly plates 112 and 112'.

The assembly plates 112 are provided with the left and right ends thereof with the stepped coupling portions 114 to allow the different assembly plates 112 and 112' to horizontally overlap and be assembled with each other.

FIGS. 16A and 16B illustrate that the different assembly plates 112 and 112' are horizontally assembled with each other.

To this end, one assembly plate 112 is formed at both sides thereof with the stepped coupling portions 114 to allow the other assembly plate 112' to overlap with the assembly plate 112.

The stepped coupling portions 114 may be shaped such that the thickness of the overlapped portion between one assembly plate 112 and the other assembly plate 112' is not greater than the thickness of the assembly plates 112 and 112'.

At this time, the stepped coupling portions 114 formed at both sides of the assembly plate 112 may be oppositely formed such that one of them is engraved in the inner surface of the assembly plate 112 and the other one is engraved in the outer surface of the assembly plate 112.

This serves to allow the stepped coupling portion 114 engraved in the inner surface of one assembly plate 112 to come into close contact with the stepped coupling portion 114 engraved in the outer surface of the other assembly plate 112' and to ensure that the thickness of the overlapped portion is not greater than the thickness of the assembly plates 112 and 112'.

Here, the stepped coupling portions 114 and 114' are formed with the net holes 126 and 126' respectively.

Since the nut holes 126 and 126' formed in the stepped coupling portions 114 and 114' are positioned to correspond to each other, when the stepped coupling portions 114 and 114' overlap each other, the nut holes 126 and 126' define a passage through the stepped coupling portions 114 and 114'.

The stepped coupling portions 114 and 114' may be firmly coupled to each other by the fastening bolts 128 that are fastened to or unfastened from the nut holes 126 and 126'.

Likewise, separation of the two assembly plates 112 and 112' may be simply implemented by separating the fastening bolts 128 from the nut holes 126 and 126'.

In this way, the assembly plates 112 and 112' may be horizontally assembled with one another to achieve a circular or polygonal cross sectional shape in a plan view.

In particular, after the assembly plates 112 and 112' are assembled with one another to construct a single layer having a circular or polygonal cross sectional shape in a plan view, other assembly plates 112 and 112' may be vertically assembled with one another above or below the previously assembled ones.

This vertical assembly of the assembly plates 112 and 112' will be described below in detail with reference to FIGS. 17A and 17B.

FIG. 17A is a view illustrating another embodiment of FIGS. 16A and 16B and FIG. 17B is a view illustrating the embodiment of FIG. 17A.

FIGS. 17A and 17B illustrate that the different assembly plates 112 and 112' are vertically assembled with one another.

Referring to FIGS. 17A and 17B with reference to FIGS. 16A and 16B, the connection unit 120 has the coupling bosses 122 formed at the upper portion of one assembly plate 112 to enable coupling or separation of the assembly plates 112 and 112'.

In addition, the connection unit 120 further includes the coupling recesses 124 formed at the lower portion of the other assembly plate 112' for insertion of the coupling bosses 122.

The assembly plates 112 and 112' are provided at the left and right ends thereof with the stepped coupling portions 114 to allow the different assembly plates 112 and 112' to horizontally overlap and be assembled with each other.

The coupling bosses 122 formed in one assembly plate 112 and the coupling recesses 124 formed in the other assembly plate 112' function to allow the assembly plates 112 and 112' to be vertically coupled to each other.

The stepped coupling portions 114 function to allow the different assembly plates 112 and 112' to be horizontally assembled with each other.

Here, each coupling boss 122 includes a coupling head 123 configured to be inserted into the coupling recess 124 and a connection pin 121 to connect the coupling head 123 and the assembly plate 112 to each other, the connection pin 121 having a smaller peripheral length than the coupling head 123.

In addition, each coupling recess 124 includes a head recess 125 for insertion of the coupling head 123 and a pin recess 127 for horizontal movement of the coupling head 122 inserted into the coupling recess 124, the pin recess 127 having a peripheral length corresponding to that of the connection pin 121.

That is, the coupling recess 124 has differently sized regions in the horizontally direction.

Considering connection between the coupling boss 122 and the coupling recess 124, as the coupling head 123 formed at the upper portion of the assembly plate 112 passes through the head recess 125 of the other assembly plate 112' and then is horizontally moved, the connection pin 121 of the assembly plate 112 is inserted into and supported by the pin recess 127 of the other assembly plate 112'.

In this way, the assembly plate 112 and the other assembly plate 112' may be vertically stacked one above another.

At this time, as the coupling flange 116 formed at the lower end of the other assembly plate 112' is seated on the upper end of the assembly plate 112 vertically coupled to the lower end of the other assembly plate 112', the two assembly plates 112 and 112' may be stably coupled and fixed to each other.

In this way, a plurality of different assembly plates 112 and 112' may be vertically coupled to the upper and lower ends of the assembly plates 112 and 112'.

Likewise, upon separation of the assembly plates 112 and 112', the assembly plate 112 coupled to the lower end of the other assembly plate 112' is horizontally moved so that the connection pin 121 located in the pin recess 127 is moved to the head recess 125.

Then, as the coupling head 123 is separated from the head recess 125, the assembly plates 112 and 112' are separated from each other.

At this time, the above-described vertical coupling method of the two assembly plates 112 and 112' is given by way of example, and the connection unit 120 may have various other shapes so long as it can provide firm coupling of the assembly plates 112 and 112'.

The assembly plates 112 and 112' may be horizontally coupled to or separated from each other by coming into close contact with each other by the stepped coupling portions 114 and 114' thereof. In addition, the assembly plates 112 and 112' may be vertically coupled to or separated from each other by the coupling bosses 122 and the coupling recesses 124 of the connection unit 120 formed at the assembly plates 112 and 112'.

In addition, the connection unit 120 may further include the nut holes 126 formed at corresponding positions of the rims of the respective assembly plates 112 and 112' to assist separation or coupling of the different assembly plates 112 and 112' and the fastening bolts 128 separably fastened to the nut holes 126.

After the nut holes 126 formed in the respective assembly plates 112 and 112' are aligned along same horizontal line, the fastening bolts 128 are fastened through the nut holes 126 to achieve more firm coupling of the assembly plates 112 and 112'.

FIG. 18 is a view illustrating the clinker removal device of the air cooled combustion furnace system according to the present invention, FIG. 19 is a view illustrating a cross section of the clinker removal device of the air cooled combustion furnace system according to the present invention, FIG. 20 is a cross sectional view illustrating the use state of the clinker removal device according to the present invention, and FIG. 21 is a plan view illustrating the use state of the clinker removal device for the combustion furnace according to the present invention.

Referring to FIGS. 18 to 21, the grate 510 on which combustion of the solid fuel 10 is implemented is located at the bottom of the combustion body structure 100 having a space for combustion of the solid fuel 10.

As impurities contained in the solid fuel 10 ignite while the solid fuel 10 is combusted on the grate 510, clinkers 30 are generated and fused to the grate 510.

At this time, when the clinkers 30 are not removed, combustion efficiency of the solid fuel 10 may be deteriorated and structures including the grate 510 may be damaged.

For this reason, the clinkers 30 need to be repeatedly removed. To this end, the clinker removal device 600 is used.

The clinker removal device 600 includes a plurality of clinker removers 610 to remove the clinkers 30 via frictional contact with the clinkers 30 adhered to the grate 510.

At this time, the clinker removers 610 may be iron blades to cut off the clinkers 30 or to separate the clinkers 30 from the grate 510.

In addition, the clinker removers 610 may be formed of various materials so long as these materials ensure smooth removal of the clinkers 30 from the grate 510.

Here, the clinker removers 610 may have a triangular side cross section.

It will be appreciated that the above-described shape of the clinker removers 610 is given by way of example and various other shapes and sizes of the clinker removers may be used according to the user's needs.

At this time, in consideration of the fact that the interior of the combustion body structure 100 remains at a high temperature of about 900° C. to 1500° C. via combustion of the solid fuel 10, the clinker removal device 600 including the clinker removers 610 are formed of a heat resistant metal.

The clinker removers 610 are adapted to remove the clinkers 30 by coming into frictional contact with the clinkers 30 via high speed rotation thereof.

To allow the clinker removers 610 spaced apart from the grate 510 to remove the clinkers 30 from the grate 510 via rotation thereof, a clinker cooler 620 is used to rotatably support the clinker removers 610.

At this time, the clinker cooler 620 functions not only to rotatably support the clinker removal device 600, but also to cool the clinker removal device 600.

To this end, the clinker cooler 620 includes a cooling housing 621 composed of a rod-shaped inner cooling pipe 622 inserted into the combustion body structure 100 and a rod-shaped outer cooling pipe 624 extending from the inner cooling pipe 622 so as to be located at the outside of the combustion body structure 100.

In particular, the clinker cooler 620 extends into the combustion body structure 100 from the outside. As needed, a plurality of clinkers may be arranged.

In the present invention, a pair of clinker coolers 620 may be arranged to face each other and extend into the combustion body structure 100 from the outside.

In addition, an entrance guide device 160 is formed at a lower portion of the combustion body structure 100 to assist the inner cooling pipe 622 in being introduced into the combustion body structure 100.

That is, the clinker cooler 620 has a tip end inserted into the combustion body structure 100 through the entrance guide device 160 and a distal end located at the outside of the combustion body structure 100. As such, the clinker cooler 620 allows a portion thereof introduced into the combustion body structure 100 to be cooled via circulation of water or air.

As described above, the clinker removal device 610 protrudes from the outer surface of the clinker cooler 620 inserted into the combustion body structure 100 and removes the clinkers 30 generated at the grate 510 by being rotated according to rotation of the clinker cooler 620 connected thereto.

The outer cooling pipe 624 of the clinker cooler 620 located at the outside of the combustion body structure 100 is provided with a power transmission mechanism 630 to transmit power required for rotation of the clinker cooler 620.

The power transmission mechanism 630 is located at the outside of the combustion body structure 100 and connected to the outer cooling pipe 624 to rotate the outer cooling pipe 624 and, consequently, to rotate the clinker removers 610 connected to the inner cooling pipe 622.

To this end, the power transmission mechanism 630 is composed of a clinker protruding gear 632 protruding from the outer surface of the outer cooling pipe 624, a clinker chain 634 connected to the clinker protruding gear 632, a clinker connection gear 636 connected to the clinker chain 634 and located opposite to the clinker protruding gear 632, and a clinker motor 638 connected to the clinker connection gear 636 to rotate the clinker connection gear 636.

Here, the above-described configuration of the power transmission mechanism 630 is given by way of example and may be replaced with various other elements such as, for example, a pulley and a belt, according to the user's needs so long as they can smoothly rotate the clinker cooler 620.

Meanwhile, the clinker cooler 620 further includes constituent elements as described below in order to cool and rotate the inner cooling pipe 622 and the clinker removal device 600 inserted into the combustion body structure 100.

In addition, the clinker cooler 620 may use water and air as a cooling catalyst to cool the inner cooling pipe 622 and the clinker removal device 600.

In the case where water is used as a cooling catalyst, the clinker cooler 620 includes a partitioned cooling vessel 625 extending outward from the outer cooling pipe 624 to separate cooling water 50 introduced from an external water source from cooling water 50 to be discharged from the cooling vessel 625 after being circulated through the cooling housing 621.

The clinker cooler 620 further includes a joint 627 that interconnects the cooling housing 621 and the partitioned cooling vessel 625 to maintain the partitioned cooling vessel 625 in a stationary state during rotation of the cooling housing 621.

The clinker cooler 620 further includes supply and drain pipes 629 consisting of an inlet pipe 626 connected to the outer surface of the partitioned cooling vessel 625 for introduction of the cooling water 50 and an outlet pipe 628 for discharge of the cooling water 50 circulated in the cooling housing 621.

The clinker cooler 620 further includes a cooling supply pipe 631 connected to the inlet pipe 626 to extend through the interior of the partitioned cooling vessel 625 and the interior of the cooling housing 621 so as to allow the cooling water 50 introduced through the inlet pipe 626 to be supplied into the cooling housing 621.

The partitioned cooling vessel 625 functions to isolate the cooling water 50 introduced into the cooling supply pipe 631 through the inlet pipe 626 from the cooling water 50 to be discharged through the outlet pipe 628 after being circulated through the inner cooling pipe 622 and the outer cooling pipe 624.

The cooling housing 621 functions to allow rotation of the clinker removal device 600 and to cool the clinker removal device 600 and the inner cooling pipe 622.

The joint 627 is provided between the partitioned cooling vessel 625 and the outer cooling pipe 624 of the cooling housing 621 to maintain the partitioned cooling vessel 625 in a stationary state during rotation of the cooling housing 621.

The cooling supply pipe 631 passes through the joint 627 and is connected to the inlet pipe 626 so as to extend from the interior of the outer cooling pipe 624 to the interior of the inner cooling pipe 622.

As the cooling supply pipe 631 is installed to pass through the joint 627, the cooling water 50 circulated in the cooling housing 621 may be guided to pass through the interior of the joint 627 along the outer diameter of the cooling supply pipe 631.

That is, the cooling supply pipe 631 maintained in a stationary state functions to supply the cooling water 50 to the inner cooling pipe 622, and the cooling housing 621 is rotated by the power transmission mechanism 630 without interference of the cooling supply pipe 631.

One or more pipe support bearings 615 are installed around the outer cooling pipe 624 to rotatably support the cooling housing 621 and a support table 617 is located below the outer cooling pipe 624 to support the pipe support bearings 615.

The pipe support bearings 615 function to support the cooling housing 621 and to minimize friction of the cooling housing 621 during rotation of the cooling housing 621.

At this time, the clinker cooler 620 is configured such that the diameter of the inner cooling pipe 622 is greater than the diameter of the outer cooling pipe 624.

The reason why the diameter of the inner cooling pipe 622 is greater than the diameter of the outer cooling pipe 624 is to cause bottleneck phenomenon when the cooling water 50 is moved from the inner cooling pipe 622 to the outer cooling pipe 624, thereby reducing a discharge rate of the cooling water 50.

FIG. 22 is a view illustrating important parts of the clinker removal device according to the present invention.

Referring to FIG. 22 with reference to FIG. 20, the entrance guide device 160 includes a first sealing bearing 161 configured to surround the outer surface of a connection region of the inner cooling pipe 622 and the outer cooling pipe 624 and a first sealing door 162 to isolate the interior of the combustion body structure 100 from the outside.

The entrance guide device 160 further includes a second sealing bearing 165 configured to surround the outer surface of the inner cooling pipe 622 located inside the first sealing door 162 and a second sealing door 166 to doubly isolate the interior of the combustion body structure 100 from the outside along with the first sealing door 162.

The first sealing door 162 is provided with a cooling injection port 164 to inject air into a space between the first sealing door 162 and the second sealing door 166 so as to cool the space.

At this time, the first sealing door 162 and the first sealing bearing 161 function to isolate the interior of the combustion body structure 100 from the outside while surrounding the outer diameter of the outer cooling pipe 624 and do not interfere with the outer cooling pipe 624 during rotation of the outer cooling pipe 624.

In addition, the second sealing door 166 and the second sealing bearing 165 function to isolate the interior of the combustion body structure 100 from the outside while surrounding the outer diameter of the outer cooling pipe 624 and do not interfere with the outer cooling pipe 624 during rotation of the outer cooling pipe 624.

That is, the second sealing door 166 is located inside the lower portion of the combustion body structure 100 and functions to prevent hot air inside the combustion body structure 100 from leaking outward through the second sealing door 166.

The second sealing bearing 165 serves to minimize frictional resistance during rotation of the outer cooling pipe 624 while applying pressure to the outer circumference of the outer cooling pipe 624.

The first sealing door 162 is located outside the lower portion of the combustion body structure 100 and functions to prevent hot air having passed through the second sealing door 166 from leaking from the combustion body structure 100.

The first sealing bearing 161 also serves to minimize frictional resistance during rotation of the outer cooling pipe 624 while applying pressure to the outer circumference of the outer cooling pipe 624.

As described above, the first sealing door 162 is provided with the cooling injection port 164 to inject air into the space between the first sealing door 162 and the second sealing door 166 from the outside of the first sealing door 162 so as to cool the space.

The cooling air injected into the cooling injection port 164 directly cools the space between the first sealing door 162 and the second sealing door 166, thereby protecting nearby constituent elements of the combustion body structure 100.

Consequently, the entrance guide device 160 has a dual configuration including the first sealing door 162 and the second sealing door 166, and allows the clinker cooler 620 to be operated while being smoothly introduced into and connected to the combustion body structure 100.

FIG. 23 is a view illustrating an embodiment of the air cooled combustion furnace system according to the present invention.

Referring to FIG. 23, the cooling device 200 includes a flow rate sensor 203 to measure the flow rate of air supplied into the cooling device 200 and an air regulation device 205 to regulate the flow rate of air to be supplied to the cooling device 200 according to the flow rate of air measured by the flow rate sensor 203.

A damper or a mass flow controller (MFC) may be used as the air regulation device 205.

Here, the flow rate sensor 203 may be configured so as to extend into the combustion body structure 100 from the outside according to the user's needs so long as it can measure the pressure of air supplied into the cooling device 200 and may be installed to each of the first, second, third, fourth, fifth and sixth coolers 210, 220, 230, 240, 250 and 260.

Likewise, the flow rate sensor 203 may be located at various desired positions so long as it can measure the pressure of air supplied into the cooling device 200.

The flue 310 is connected to the top of the combustion body structure 100 and the negative pressure generator 320 is connected to the flue 310. The flue 310 and the negative pressure generator 320 constitute the negative pressure induction device 300.

The negative pressure induction device 300 further includes a pressure sensor 209 to measure the interior pressure of the combustion body structure 100 and a temperature sensor 201 to measure the interior temperature of the combustion body structure 100.

Here, the temperature sensor 201 may be installed to each of the first, second, third, fourth, fifth and sixth coolers 210, 220, 230, 240, 250 and 260 to acquire temperature information on a per region basis.

The combustion body structure 100 incorporates a controller 102 to receive numerical information measured by the flow rate sensor 203, the pressure sensor 209 and the temperature sensor 201 and to control the air regulation device 205 and the negative pressure induction device 300 based on the numerical information.

Here, it will be appreciated that the positions and the number of the flow rate sensor 203, the pressure sensor 209 and the temperature sensor 201 may be modified in various ways according to the user's needs.

The pressure sensor 209 may be installed to each of the first, second, third, fourth, fifth and sixth coolers 210, 220, 230, 240, 250 and 260 and may also be installed to the negative pressure generator 320, in order to reliably measure a difference between the internal pressure and the external pressure of the combustion body structure 100.

The controller 102 provided at the combustion body structure 100 which receives a pressure value measured by the flow rate sensor 203 and the pressure sensor 209 and controls the air regulation device 205 and the negative pressure induction device 300 based on the pressure value.

At this time, the flow rate sensor 203 and the pressure sensor 209 are connected to a transmitter (not illustrated) which checks information regarding air pressure inside and outside of the combustion body structure 100 and transmits the checked information to the controller 102.

The combustion body structure 100 is provided with a start-up burner 104 to produce a flame within the combustion body structure 100 for ignition of the solid fuel 10.

Here, the start-up burner 104 may have various shapes and may be located at various positions according to the user's needs upon manufacture of the system.

The combustion body structure 100 is further provided with an energy converter 106 to convert heat energy generated in the combustion body structure 100 into steam or electricity.

At this time, the energy converter 106 may function to allow steam, converted from heat energy generated in the combustion body structure 100, to be directly used or to be reconverted into electricity.

The energy converter 106 may be, for example, a boiler that performs energy conversion via a generator.

The negative pressure induction device 300 includes the flue 310 connected to the top of the combustion body structure 100 and the negative pressure generator 320 connected to the flue 310.

The negative pressure induction device 300 further includes a noxious gas processing unit 330 to suction and remove or decompose a combustion gas containing a gas-phase noxious material and noxious material particles.

The noxious gas processing device 300 is connected to the flue 310 and located between the energy converter 106 and the negative pressure generator 320 and functions to decompose or remove a noxious gas.

The noxious gas processing unit 330 may be, for example, an SNCR, SCR, SDR, DR, or bag-filter.

The energy converter 106 may be operated using heat energy generated from the solid fuel 10 that is acquired by processing a waste fuel, thereby reducing energy consumption costs.

In addition, the combustion body structure 100 is provided at a lower end thereof with a plurality of wheels 101 for smooth movement of the combustion body structure 100.

The wheels 101 may be stably kept stationary using fixing members 108 located adjacent to the wheels 101 during operation of the combustion body structure 100.

As is apparent from the above description, the present invention may advantageously accomplish efficient cooling of a combustion furnace by smoothly supplying cooling air to the entire wall surface of the combustion furnace and creating a combustion atmosphere within the combustion furnace by introducing preheated air into the combustion furnace.

Further, through efficient cooling of the combustion furnace, the present invention may advantageously extend the lifespan of constituent elements inside and outside the combustion furnace, thereby reducing production and management costs.

Furthermore, by quantitatively controlling the input amount of a solid fuel into the combustion furnace, the present invention may advantageously prevent any accident such as, for example, a fire and explosion due to excessive fuel supply.

In addition, the present invention may advantageously improve durability and productivity with regard to production of heat energy, thereby achieving optimized reliability and productivity.

In particular, the present invention may advantageously prevent malfunction of a combustion device by smoothly removing clinkers during operation of the combustion device.

In addition, even if the inner wall of the combustion furnace is damaged, the present invention may advantageously achieve simplified replacement of a local damaged region of the inner wall, which may advantageously result in improved operation efficiency and reduced replacement costs.

In addition, when a grate installed in the combustion furnace is thermally deformed, the present invention may provide simplified replacement of a deformed part of the grate, which may advantageously reduce replacement costs of constituent elements.

Although the present invention has been described with regard to specific facts, such as, for example, detailed constituent elements, the limitative embodiments and the accompanying drawings, the above description has been made only for a better understanding of the present invention and the present invention should not be limited to the above-described embodiments. Those skilled in the art may acquire various modifications, additions and substitutions from the above description.

Accordingly, the scope of the present invention should not be limited to and defined by the above-described embodiments, and the invention is to cover all modifications, equivalents, and alternatives falling within the spirit and scope of the invention as defined by the claims.

What is claimed is:

1. An air cooled combustion furnace system comprising:

a combustion body structure including a hopper for introduction of a solid fuel into the combustion body structure, the combustion body structure defining a combustion space in which the solid fuel introduced through the hopper is combusted and generates heat energy;

a cooling device integrally formed at an outer surface of the combustion body structure, the cooling device being vertically divided into a plurality of stories to cool the combustion body structure via distribution and injection of air into the respective stories;

a negative pressure induction device connected to the top of the combustion body structure, the negative pressure induction device being configured to create a negative pressure within the combustion body structure by suctioning air introduced into the combustion body structure by the cooling device;

a fuel supply device extending into the combustion body structure from the outside so as to supply the solid fuel into the combustion body structure;

a grate device including a grate located within the combustion body structure to define a bottom surface of the combustion body structure, the grate being constructed by coupling a plurality of grate segments to one another and configured to support the solid fuel during combustion of the solid fuel, the grate device allowing the solid fuel to be combusted while being disposed on an upper surface thereof; and a clinker removal device configured to remove clinkers generated as the solid fuel is combusted on the grate device, wherein the cooling device includes:

a flow rate sensor configured to measure a pressure of air supplied into the cooling device; and an air regulation device configured to regulate the flow rate of air supplied into the cooling device according to the pressure of air measured by the flow rate sensor, wherein the negative pressure induction device includes:

a pressure sensor configured to measure an interior pressure of the combustion body structure; and a temperature sensor configured to measure an interior temperature of the combustion body structure, wherein the combustion body structure includes a controller configured to receive a flow rate value and a pressure value measured by the flow rate sensor and the pressure sensor and to control the air regulation device and the negative pressure induction device based on the flow rate value and the pressure value, wherein the grate device further includes:

a turntable connected to the bottom of the grate to rotate the grate, the grate being configured to surround an outer surface of the hopper; and a support body configured to support the bottom of the turntable, the support body being provided at an upper surface thereof with a roller to assist rotation of the turntable and supported at a lower surface thereof by the ground, and wherein the support body includes:

an auxiliary body fixed to the hopper so as to surround the outer surface of the hopper, the auxiliary body being provided at an outer surface thereof with multiple stepped portions to support inner rims of the turntable and the grate;

a cylindrical up-and-down moving pipe connected to a lower portion of the hopper; and a height regulator fixed to an outer circumference of the up-and-down moving pipe so as to upwardly or downwardly move the up-and-down moving pipe.

2. The air cooled combustion furnace system according to claim 1, wherein the combustion body structure includes:

a plurality of assembly units configured to be assembled with one another so as to construct an inner wall of the combustion body structure; and a connection unit configured to enable separable coupling of the assembly units.

3. The air cooled combustion furnace system according to claim 1, wherein the fuel supply device includes:

a conveyor configured to convey the solid fuel;

a tubular cylinder into which the solid fuel conveyed from the conveyor is introduced; and a cylinder rod configured to be partially inserted into the cylinder so as to push and convey the solid fuel introduced into the cylinder via reciprocating movement thereof.

4. The air cooled combustion furnace system according to claim 1, wherein the height regulator includes:

an elevating plate horizontally connected to the up-and-down moving pipe;

an inclined plate located below the elevating plate and having an outwardly downwardly inclined side cross section;

a moving piece located below the inclined plate and having an outwardly upwardly inclined side cross section, the moving piece being moved inside the inclined plate so as to upwardly or downwardly move the inclined plate;

a screw bolt configured to be rotated inside the moving piece so as to move a position of the moving piece; and a stopper protruding from an outer surface of the screw bolt to control movement of the moving piece on the screw bolt.

5. The air cooled combustion furnace system according to claim 1, wherein the combustion body structure further includes:

a start-up burner configured to produce a flame within the combustion body structure so as to ignite the solid fuel; and an energy converter configured to convert heat energy generated in the combustion body structure into steam or electricity, and wherein the negative pressure induction device includes:

a flue connected to the top of the combustion body structure;

a negative pressure generator connected to the flue; and a noxious gas processing unit located between the flue and the negative pressure generator to remove or decompose a combustion gas containing a gas-phase noxious material and noxious material particles.

6. The air cooled combustion furnace system according to claim 1, wherein the cooling device includes:

a first cooler configured to supply air to the bottom of the combustion body structure so as to cool the bottom of the combustion body structure;

a second cooler assembled to the top of the first cooler, the second cooler being configured to supply air so as to cool a lower outer surface of the combustion body structure;

a third cooler assembled to the top of the second cooler, the third cooler having a vertical partition to divide the interior of the third cooler into two regions and configured to allow air, introduced from the outside, to be directed to an inner lower region of the combustion body structure;

a fourth cooler assembled to the top of the third cooler, the fourth cooler having a vertical partition to divide the interior of the fourth cooler into two regions and configured to allow air, introduced from the outside, to be directed to a region between an inner upper region and the inner lower region of the combustion body structure;

a fifth cooler assembled to the top of the fourth cooler, the fifth cooler having a vertical partition to divide the interior of the fifth cooler into two regions and configured to allow air, introduced from the outside, to be circulated along the inner side and the outer side of the partition so as to cool the outer surface of the combustion body structure; and a sixth cooler assembled to the top of the fifth cooler, the sixth cooler having a diagonal partition to divide the interior of the sixth cooler into two regions and also having a top opening, the sixth cooler being shaped such that an inner diameter thereof is gradually reduced upward and configured to allow, air introduced from the outside, to be circulated along the inner side and the outer side of the partition so as to cool the outer surface of the combustion body structure.

7. The air cooled combustion furnace system according to claim 6, wherein each of the first, second, third, fourth, fifth and sixth coolers has an air inlet port configured to receive air from the outside and to supply the air to the combustion body structure.

8. The air cooled combustion furnace system according to claim 6, wherein each of the third cooler and the fourth cooler accommodates an eddy piece configured to guide diagonal movement of air introduced from the outside so as to allow the air to be swirled in the cooler.

9. The air cooled combustion furnace system according to claim 1, wherein the clinker removal device includes:

a clinker remover inserted into the combustion body structure to remove clinkers generated at the grate;

a clinker cooler configured to extend from the interior of the clinker remover to the outside of the combustion body structure through an entrance guide device formed at a lower portion of the combustion body structure, so as to cool the clinker remover via circulation of water or air; and a power transmission mechanism connected to the clinker cooler at the outside of the combustion body structure, the power transmission mechanism being configured to transmit power to enable rotation of the clinker cooler.

10. The air cooled combustion furnace system according to claim 9, wherein the clinker cooler includes:

a cooling housing composed of a rod-shaped inner cooling pipe inserted into the combustion body structure through the entrance guide device and a rod-shaped outer cooling pipe extending from the inner cooling pipe so as to be located at the outside of the combustion body structure;

a partitioned cooling vessel configured to extend outward from the outer cooling pipe so as to separate cooling water, introduced from the outside, from cooling water to be discharged outward after being circulated through the cooling housing;

a joint configured to interconnect the cooling housing and the partitioned cooling vessel so as to maintain the partitioned cooling vessel in a stationary state during rotation of the cooling housing;

a supply and drain pipe consisting of an inlet pipe connected to an outer surface of the partitioned cooling vessel for introduction of the cooling water and an outlet pipe for discharge of the cooling water circulated in the cooling housing; and a cooling supply pipe connected to the inlet pipe to extend through the interior of the partitioned cooling vessel and the interior of the cooling housing so as to allow the cooling water, introduced through the inlet pipe, to be supplied into the cooling housing.

11. The air cooled combustion furnace system according to claim 10, wherein the entrance guide device includes:

a first sealing bearing configured to surround an outer surface of a connection region of the inner cooling pipe and the outer cooling pipe;

a first sealing door configured to isolate the interior of the combustion body structure from the outside;

a second sealing bearing configured to surround an outer surface of the inner cooling pipe located inside the first sealing door; and a second sealing door configured to secondarily isolate the interior of the combustion body structure from the outside, along with the first sealing door.

12. The air cooled combustion furnace system according to claim 9, wherein the clinker remover includes a plurality of removal blades integrally protruding from an outer surface of the clinker cooler partially inserted into the combustion body structure so as to be arranged side by side, the blades being adapted to remove the clinkers generated at the grate by being rotated as the clinker cooler connected thereto is rotated.

* * * * *